US010183800B2

(12) United States Patent
Bressan et al.

(10) Patent No.: US 10,183,800 B2
(45) Date of Patent: Jan. 22, 2019

(54) CONTAINER FOR DELIVERING A PREFIXED NUMBER OF PRODUCTS AT A TIME AND A PROCESS FOR MAKING OF SAID CONTAINER

(71) Applicant: I.G.B.S.R.L., Milan (IT)

(72) Inventors: Michel Bressan, Induno Olona (IT); Alberto Gandolla, Induno Olona (IT)

(73) Assignee: I.G.B. S.r.l., Milan (IT)

( * ) Notice: Subject to any disclaimer, the term of this patent is extended or adjusted under 35 U.S.C. 154(b) by 46 days.

(21) Appl. No.: 15/303,630

(22) PCT Filed: Apr. 1, 2015

(86) PCT No.: PCT/IB2015/052399
§ 371 (c)(1),
(2) Date: Oct. 12, 2016

(87) PCT Pub. No.: WO2015/159174
PCT Pub. Date: Oct. 22, 2015

(65) Prior Publication Data

US 2017/0036846 A1 Feb. 9, 2017

(30) Foreign Application Priority Data

Apr. 16, 2014 (IT) ..... MI2014A0712

(51) Int. Cl.
*B65D 83/04* (2006.01)
*B65D 5/72* (2006.01)
(Continued)

(52) U.S. Cl.
CPC ..... *B65D 83/0409* (2013.01); *A61J 7/0076* (2013.01); *B65D 5/723* (2013.01); *B65D 85/60* (2013.01)

(58) Field of Classification Search
USPC ..... 221/260, 267, 268, 305
See application file for complete search history.

(56) References Cited

U.S. PATENT DOCUMENTS 1,889,232 A 11/1932 Ware
2,472,871 A * 6/1949 Williamson ..... B65D 83/0409 221/263
(Continued)

FOREIGN PATENT DOCUMENTS

DE 8512677 U1 6/1985
EP 3131823 U1 2/2017
(Continued)

OTHER PUBLICATIONS

Search Report and Written Opinion of International Application No. PCT/IB2015/052399, dated Oct. 22, 2015, 9 pages.
(Continued)

*Primary Examiner* — Timothy R Waggoner
*Assistant Examiner* — Ayodeji T Ojofeitimi
(74) *Attorney, Agent, or Firm* — Fish & Richardson P.C.

(57) ABSTRACT

A container for delivering a predetermined number of products at a time includes a compartment defining an inner volume and configured to house multiple products, a passageway having an outlet configured to enable the delivery of the multiple products outside of the container, a door defining an opening configured to put the compartment in communication with the passageway, and a delivery mechanism arranged at the door and configured to manage passage of the multiple products through the door. The delivery mechanism is configured to be placed in a closing condition in which the delivery mechanism prevents passage of the multiple products through the door, and the delivery mechanism is further configured to be placed in a passage condition in which the delivery mechanism allows passage of one or more products of the multiple products through the door, thus allowing the one or more products to exit the compartment.

13 Claims, 11 Drawing Sheets

(51) Int. Cl.
*A61J 7/00* (2006.01)
*B65D 85/60* (2006.01)

(56) References Cited

U.S. PATENT DOCUMENTS 3,186,591 A * 6/1965 Solomon ..... B65D 5/5016
221/260
3,430,810 A * 3/1969 Willette ..... B65D 83/0409
221/205
6,089,416 A * 7/2000 Mellon ..... G01F 11/261
222/456
6,206,235 B1 * 3/2001 Green ..... B65D 83/0409
221/204
6,726,058 B2 * 4/2004 Giraud ..... B65D 83/0409
221/267
8,459,498 B2 * 6/2013 Giraud ..... A47F 1/10
221/251
2003/0226879 A1 * 12/2003 Auclair ..... B65D 5/5495
229/120.011

FOREIGN PATENT DOCUMENTS

JP H01111374 U 7/1989
WO WO2015159174 U1 10/2015

OTHER PUBLICATIONS

International Preliminary Repot on Patentability of International Application No. PCT/IB2015/052399, dated Oct. 18, 2016, 7 pages.

* cited by examiner

FIG.4
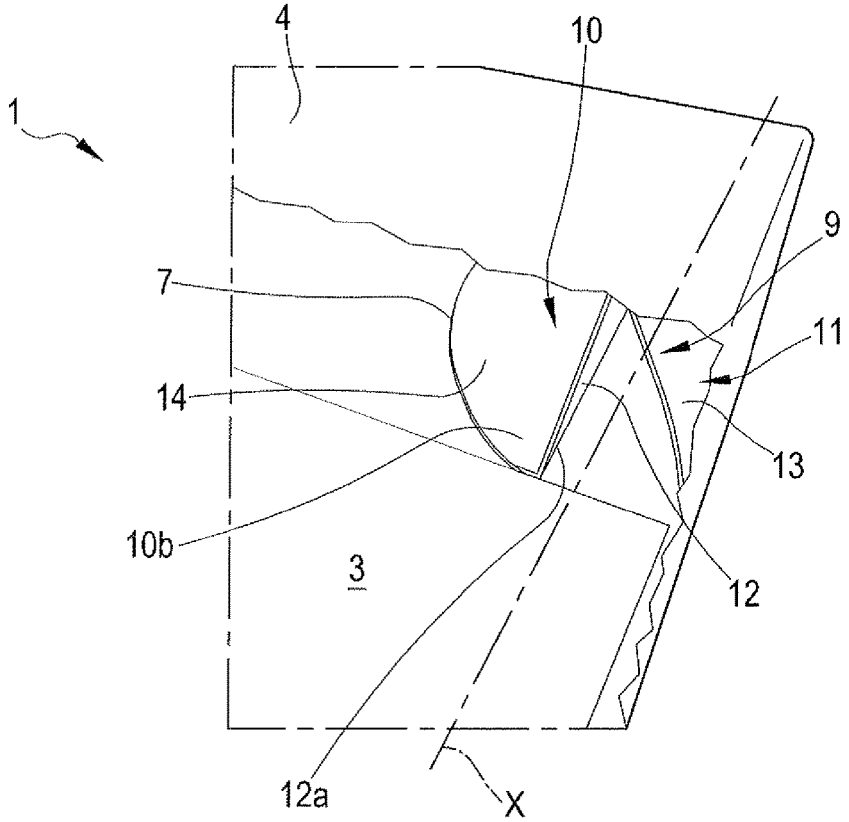
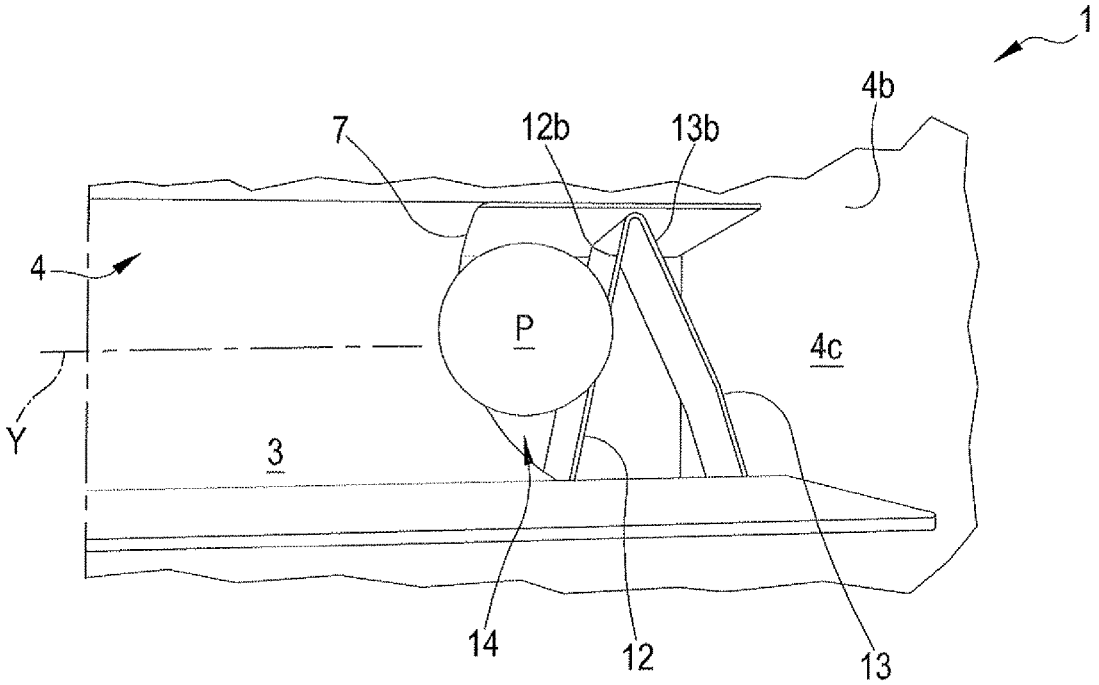
FIG.5

CONTAINER FOR DELIVERING A PREFIXED NUMBER OF PRODUCTS AT A TIME AND A PROCESS FOR MAKING OF SAID CONTAINER

CROSS REFERENCE TO RELATED APPLICATIONS

This patent application is a 371 U.S. National Application of PCT/IB2015/052399, filed Apr. 1, 2015, which claims priority to MI2014A000712, filed Apr. 16, 2014, the entire contents of which are incorporated herein by reference.

TECHNICAL FIELD

The present invention refers to a container for delivering a prefixed number of products at a time and to a process for making said container. The container can find an application in the confectionery field, for example for defining portable dispensers adapted to deliver candies, mini chocolates and/or chewing-gums. Further, the container can be used in the pharmaceutical and cosmetic fields, for example for defining portable dispensers adapted to deliver tablets and/or pills. However, the container, object of the present invention, can find an advantageous application in all the fields providing to delivery, from a portable dispenser, a prefixed number of products, particularly one selected among a plurality housed in a compartment. Therefore, the above cited examples must be considered in a non limiting way because the products deliverable from the container, object of the present invention, can be of different kind, for example can comprise cigarettes.

BACKGROUND

It is known how to make portable dispensers for small-sized products, such as tablets, pills and/or candies, configured for housing a plurality of said products and enabling to deliver them. Such dispensers are configured for enabling to deliver only one product at a time by activating a mechanism received inside the dispenser. The known containers are usually made, in all their parts, of plastic material and are obtained by molding.

Generally, the known containers consist of two half-shells of plastic material couplable to each other for defining an inner compartment containing the products: the compartment exhibits an opening for enabling to delivery outside said products. A mechanism—made of different parts and different materials—is housed inside the container—the mechanism operates at the outlet for managing just the delivery of the products. By making reference to a particular case, the mechanism can consist of an extracting drawer, normally placed in a compartment closed condition; a metal spring configured for automatically bringing back the drawer from a delivery condition to a closed condition is associated to the extraction drawer.

As hereinbefore discussed, containers adapted to delivery only one product at a time are already known; such containers are generally provided with a dosing chamber, directly defined on the drawer, which is adapted to carry only one product. De facto, the drawer, during the container closed condition, is completely housed inside the compartment: under such condition, the dosing chamber is adapted to house only one product. Upon activating the mechanism, the drawer is pushed outside the compartment: so only the product present in the dosing chamber can be delivered.

Although the described containers enable to carry and delivery products, the Applicant has found that these latter are not devoid of disadvantages and are improvable under several aspects. First of all, it is useful to note that the structural complexity of such devices comprising several elements to define the delivery mechanism entail high costs; some parts must be necessarily obtained by molding and then coupled to the remaining parts, this process being uneconomical under several points of view increases the overall cost of the product. Further it is noted that for manufacturing containers destined to the food and pharmaceutical fields (for carrying food products and tablets), it is necessary to use food-grade plastics for plastics considered "noble" because they do not release substances altering the product container in the compartment. Such plastics exhibit certainly higher costs than the costs of the common plastics, which even more burden the overall costs of the containers. As hereinbefore described, also the particularly described delivery mechanism (drawer) is normally made of plastic material and is obtained by molding: such condition entails the same above cited disadvantages to the detriment of the container overall price. Further, it is noted that, following the step of molding the several details of the known container, it is necessary a step of assembling the semi-shells, drawer and spring; such operation is generally performed by hand (with consequent high investment costs for the automation) and provides to position the mechanism inside the semi-shells and close the container. The assembly is certainly not easily implementable because it provides to handle small-sized details and is time consuming. The assembly step surely complicates the manufacturing process with a hike of the manufacturing costs and consequently of the container overall costs.

SUMMARY

Therefore, it is an object of the present invention to substantially solve at least one of the disadvantages and/or limitations of the preceding solutions. A first object of the invention consists of providing a container enabling to correctly support/contain products and which can provide to deliver a prefixed number of products at a time, preferably only one product at a time. A further main object of the invention consists of providing a simple and easily manufacturable container which enables to reduce at the minimum the product manufacturing costs. Another object of the invention consists of providing a container which is substantially capable to offer an optimal attractive aspect, but which, at the same time, is capable of maintaining simple the manufacturing and assembling processes. Then, it is a secondary object of the invention to provide a container, which can be used many times by an user and then disposed of by recycling it, once its function has terminated, without particular problems due to the unbiodegrability of the material by which it is made.

One or more of the above described objects that will appear better during the following description, are substantially met by a container for delivering a prefixed number of products at a time and a respective process according to one or more of the attached claims.

Aspects of the invention will be described in the following.

In a 1st aspect, it is provided a container (1) for delivering a prefixed number of products (P) at a time, particularly for delivering only one product (P) at a time, said container (1) comprising:

at least one compartment (2) defining an inner volume (3), configured for housing a plurality of products (P), at least one volume of passage (4) exhibiting at least one outlet (5) configured to enable the delivery of said products (P) outside the container (1), at least one door (6) defining an opening (7) configured to put in communication the compartment (2) with the volume of passage (4), at least one delivery mechanism (8) arranged at least at the door (6) and configured to manage the passage of products (P) through the door, said delivery mechanism (8) being configured to be placed at least in a closed condition in which the mechanism itself prevents the passage of products (P) from the door (6), said delivery mechanism (8) being further configured for being placed in a passage condition wherein the mechanism itself allows the passage of one or more products (P) from the door (6), thus allowing said products (P) to get out of the compartment (2), said delivery mechanism (8) comprising:

at least one shutter (9) placed at the door (6) apt to define, in cooperation with the opening (7), a prefixed section of passage, the shutter (9), in the closing condition, defining a section of passage apt to interdict the passage of products (P), the shutter (9), in the passage condition, defining a section of passage apt to enable the passage of products (P), at least one maneuvering organ (10) acting on the shutter (9) so as to command the closing and passage conditions of the delivery mechanism (8).

In a 2nd aspect according to the preceding aspect, the shutter (9) is made at least partly of sheet material.

In a 3rd aspect according to anyone of the preceding aspects, the shutter (9) has at least one folded portion (11) configured to directly define the shutting and opening body of the door (6).

In a 4th aspect according to the preceding aspect, the folded portion (11) exhibits at least a first and a second tab (12, 13) connected at an end, said tabs (12, 13) being normally arranged in a condition in which they are angularly spaced from each other for defining said closing condition of the mechanism (8), said folded portion (11) being configured to deform and allow said tabs (12, 13) to angularly approach to each other so as to define said passage condition of the mechanism (8).

In a 5th aspect according to anyone of the preceding aspects, the delivery mechanism (8) is made at least partly of paper sheet material.

In a 6th aspect according to anyone of the preceding aspects, the shutter (9) and maneuvering organ (10) are completely made of paper material.

In a 7th aspect according to anyone of the preceding aspects, the folded portion (11) of shutter (9) comprises an elastic body configured to keep the shutter itself in its closing condition.

In an 8th aspect according to the preceding aspect, the shutter (9) elastic body is configured to automatically bring the shutter itself (9) from the passage condition to the closing condition.

In a 9th aspect according to anyone of the aspects from 3 to 8, the folded portion (11) directly defines both the shutting and opening body of the door (6) and the elastic body for the springback of the shutter (9) itself.

In a 10th aspect according to anyone of the aspects from 4 to 9, the first and second tabs (12, 13) lie in respective planes parallel to a direction (X) along which the products (P) cross the door.

In an 11th aspect according to anyone of the aspects from 4 to 10, the tabs (12, 13), in the closing condition, exhibit, according to a section transversal to the crossing direction (X), a substantially "V" shape configured for obstructing the opening (7) products (P) passage.

In a 12th aspect according to anyone of the aspects from 3 to 11, the folded portion (11) defines, in the closing condition of the delivery mechanism (8) and in cooperation with the opening (7), a housing seat (14) configured for holding said prefixed number of products (P), particularly one and only one product (P), the housing seat (14) being configured to substantially define a dosing chamber which, in the condition of passage of the delivery mechanism (8), enables at least the delivery of the prefixed number of products (P) retained in the housing seat (14).

In a 13th aspect according to the preceding aspect, at least the first tab (12), in the closed condition of the delivery mechanism (8), cooperates with the opening (7) to define said housing seat (14).

In a 14th aspect according to anyone of the aspects from 4 to 13, the first tab (12), during the transit from the passage condition to the closing condition, is configured for approaching or moving away from the second tab (13) for defining said passage condition and enabling the delivery of the product (P) placed in the housing seat (14).

In a 15th aspect according to anyone of the preceding aspects, the opening (7) exhibits a prefixed area of passage, in the closing condition, the ratio of the opening (7) area of passage to the section of passage, defined by the cooperation between the shutter (9) and opening (7), is equal to or greater than 2, particularly is comprised between 2 and 5.

In a 16th aspect according to anyone of the preceding aspects, the opening (7) exhibits an area of passage comprised between 20 and 900 $mm^2$, particularly between 300 and 400 $mm^2$.

In a 17th aspect according to anyone of the preceding aspects, wherein, in the closing condition, the section of passage, defined by the cooperation between the shutter and opening (7), exhibits an extension comprised between 7 and 850 $mm^2$, particularly between 150 and 250 $mm^2$.

In an 18th aspect according to anyone of the preceding aspects, the volume of passage (4) substantially comprises a duct extending along a prevalent development direction (Y).

In a 19th aspect according to the preceding aspect, the duct exhibits, in a cross section, a polygonal shape, optionally a rectangular or square shape.

In a 20th aspect according to the aspect 18 or 19, the outlet (5) is placed at a first longitudinal end (4*a*) of the duct, while the opening (7) is substantially placed on one lateral wall of the duct at a second longitudinal end (4*b*) of the same, substantially opposite to the first longitudinal end (4*a*).

In a 21st aspect according to anyone of the aspects from 18 to 20, the duct prevalent development direction (Y) extends transversally, particularly normal, to the products (P) crossing direction (X).

In a 22nd aspect according to anyone of the preceding aspects, the maneuvering organ (10) is placed inside the volume of passage (4) and extends from a first end (10*a*), placed at the outlet (5), to a second end (10*b*) connected to the shutter (9) and arranged at the opening (7), the maneuvering organ (10) being configured to:

receive, at the first end, a thrust (S) directed towards the shutter (9), following the thrust (S), slide inside the volume to exert a thrust on the shutter (9), following the sliding action, warp, in particular elastically, the shutter (9) to move the delivery mechanism (8) from the closing condition to the passage condition.

In a 23rd aspect according to anyone of the aspects from 18 to 22, the maneuvering organ (10) is engaged inside the duct and extends from a first end (10*a*) placed at the outlet (5), to a second end (10*b*) connected to the first tab (12) and placed at the opening (7), the maneuvering organ (10) being configured to:

receive, at the first end, a thrust (S) directed along the duct prevalent development direction (Y), following the thrust (S), slide inside the duct along the prevalent development direction (Y) of the same to exert a thrust on the first tab (12), following the sliding action, warp, in particular elastically, the folded portion (11) for enabling to angularly approach the tabs (12, 13) to each other and define the condition of passage of the delivery mechanism (8).

In a 24th aspect according to anyone of the aspects from 18 to 23, the duct exhibits, at the second longitudinal end (4*b*), an opposite bottom wall (4*c*), facing the outlet (5) and placed beside the door (6) opening (7), the second tab (13) at least partially abutting on the bottom wall (4*c*), while the first tab (12) being engaged with the maneuvering organ (10).

In a 25th aspect according to anyone of the aspects from 4 to 24, the first tab (12) exhibits a rectilinear cross section extending from a first and second end edges (12*a*, 12*b*), the second tab (13) exhibits a rectilinear cross section extending from a first and second end edges (13*a*, 13*b*), and wherein the first and second tabs (12, 13) are engaged, for example integrally, with each other at the respective second end edges (12*b*, 13*b*).

In a 26th aspect according to the preceding aspect, wherein, only the first tab (12) first end edge (12*a*) is directly engaged with the maneuvering organ (10) at the second end of this latter, the second tab (13) first end edge (13*a*) abutting on the duct bottom wall (4*c*).

In a 27th aspect according to anyone of the aspects from 18 to 26, the duct, at the first end (4*a*), exhibits a recess (15) extending along the duct prevalent development direction (Y), said recess (15) being configured for enabling to push the maneuvering organ (10) inside the volume of passage.

In a 28th aspect according to the preceding aspect, the recess (15) defines a through opening (16) at a container (1) lateral wall and delimited by a free edge (17) having a substantially "U" shape in communication with the passage volume (4) outlet (5).

In a 29th aspect according to anyone of the aspects from 4 to 28, the first tab (12) exhibits a prefixed length comprised between 10 and 36 mm, particularly between 18 and 22 mm, the first tab (12) length being defined by the maximum distance between a first and second end edges (12*a*, 12*b*) of the tab itself.

In a 30th aspect according to anyone of the aspects from 4 to 29, the second tab (13) exhibits a prefixed length comprised between 11 and 42 mm, particularly between 20 and 26 mm, the second tab (13) length being defined by the maximum distance between a first and second end edges (13*a*, 13*b*) of the tab itself.

In a 31st aspect according to anyone of the aspects from 4 to 30, the first tab (12) exhibits a prefixed length defined by the maximum distance between a first and second end edges (12*a*, 12*b*) of the tab itself, the second tab (13) exhibiting a prefixed length defined by the maximum distance between a first and second end edges (13*a*, 13*b*) of the tab itself, and wherein the second tab (13) length is greater than the first tab (12) length, particularly the ratio of the second tab (13) length to the first tab (12) length is equal to or greater than 1.1, particularly is comprised between 1.15 and 1.5.

In a 32nd aspect according to anyone of the aspects from 4 to 31, the first and second tabs (12, 13), in the closing condition of the shutter (9), exhibit an angular offset inside the two tabs (12, 13) comprised between 10° and 90°, particularly between 15° and 25°.

In a 33rd aspect according to anyone of the aspects from 4 to 32, the first and second tabs (12, 13), in the passage condition of the shutter (9), are substantially parallel to each other.

In a 34th aspect according to anyone of the preceding aspects, the compartment (2) has a rectangular prismatic shape.

In a 35th aspect according to anyone of the preceding aspects, the compartment (2) defines an inner volume greater than 15000 $mm^3$, particularly comprised between 40000 and 100000 $mm^3$.

In a 36th aspect according to anyone of the preceding aspects, the duct defining a volume of passage (4) exhibits a rectangular prismatic shape.

In a 37th aspect according to anyone of the preceding aspects, the duct defines an inner volume greater than 5000 $mm^3$, particularly comprised between 30000 and 80000 $mm^3$.

In a 38th aspect according to anyone of the preceding aspects, the ratio of the compartment (2) volume to the duct volume is greater than 1.5, particularly is comprised between 2 and 20.

In a 39th aspect according to anyone of the preceding aspects, the delivery mechanism (8) is engaged inside the volume of passage (4).

In a 40th aspect according to anyone of the preceding aspects, the shutter (9) is made at least partially of paper sheet material.

In a 41st aspect according to the preceding aspect, the shutter (9) sheet material grammage is comprised between 100 and 500 $gr/m^2$, particularly comprised between 200 and 300 $gr/m^2$.

In a 42nd aspect according to anyone of the preceding aspects, the shutter (9) and maneuvering organ (10) are completely made of paper sheet material, particularly are made of a single paper sheet material.

In a 43rd aspect according to the preceding aspect, the sheet material grammage of the shutter (9) and maneuvering organ (10) is comprised between 100 and 500 $gr/m^2$, particularly is comprised between 200 and 300 $gr/m^2$.

In a 44th aspect according to anyone of the preceding aspects, the container is completely made of paper material.

In a 45th aspect according to the preceding aspect, the sheet material grammage of the whole container (1) is comprised between 100 and 500 $gr/m^2$, particularly is comprised between 200 and 300 $gr/m^2$.

In a 46th aspect according to anyone of the preceding aspects, the container is obtained by folding a single flat sheet, particularly of paper material.

In a 47th aspect according to the preceding aspect, the single sheet forming the container, exhibits a grammage comprised between 100 and 500 $gr/m^2$, particularly comprised between 200 and 300 $gr/m^2$.

In a 48th aspect according to anyone of the preceding aspects, the compartment (2), volume of passage (4) and delivery mechanism (8) are integrally joined to each other to form a single solid body.

In a 49th aspect according to anyone of the preceding aspects, the container comprises at least one closing element (18) engaged with the volume of passage (4) and/or compartment (2), said closing element (18) being placed at the outlet (5) outside the volume of passage (4) and outside the compartment (2), and wherein the closing element (18) is configured for being placed, in a condition of passage wherein the element (18) itself enables to deliver the products (P) from the outlet (5), the closing element (18) is further configured for being placed in a locking condition wherein the element (18) itself closes the outlet (5) and interdicts the delivery of products (P) from this latter.

In a 50th aspect according to the preceding aspect, the closing element (18) comprises a joint portion (19) configured for cooperating with at least the duct of the volume of passage (4) for stably holding the closing element itself in the locking condition.

In a 51st aspect, it is provided a process for making a container (1) according to anyone of the preceding aspects.

In a 52nd aspect according to the preceding aspect, the process comprises at least one step of preparing the delivery mechanism (8), the shutter (9) is made at least partly of sheet material and exhibits at least one folded portion (11), said folded portion (11) being configured to directly define the shutting and opening body of the door (6).

In a 53rd aspect according to the preceding aspect, the step of preparing the shutter (9) comprises at least the following steps:

preparing a first sheet (51), folding said first sheet (51) so as to form the folded portion (11), placing said folded portion (11) at the door (6), said folded portion (11) defining the shutting and opening element of the door (6).

In a 54th aspect according to anyone of the preceding aspects of process, the shutter comprises an elastic body configured so as to define the springback element of the shutter (9) itself.

In a 55th aspect according to anyone of the preceding aspects of process, forming the folded portion (11) provides at least the following sub-steps:

forming the first and second tabs (12, 13) so that these latter are connected at an end, placing the first and second tabs (12, 13) inside the volume of passage (4) so that the longitudinal development thereof is parallel to the direction (X) along which the products (P) cross the door, said tabs (12, 13) being normally placed in a condition wherein they are angularly spaced from each other for defining said mechanism (8) closing condition, said folded portion (11) being configured for warping, particularly elastically, for enabling to angularly approach or move away said tabs (12, 13) from each other for defining said condition of passage of the mechanism (8).

In a 56th aspect according to the preceding aspect, the tabs (12, 13), in the closing condition, along a cross section exhibit a substantially "V" shape configured for obstructing the passage of products (P) from the opening (7).

In a 57th aspect according to anyone of the aspects from 52 to 56, the step of forming the folded portion (11) comprises at least one step of placing said folded portion (11) at the door (6) so that said portion (11) can cooperate with the opening (7) for defining a housing seat (14) configured to retain only one product (P), the housing seat (14) being configured to substantially define a dosing chamber which, in the passage condition of the delivery mechanism (8), enables at least the delivery of the product (P) retained in the housing seat (14).

In a 58th aspect according to anyone of the preceding aspects of process, wherein said process comprises at least one step of forming the volume of passage (4), said step exhibiting at least the following sub-steps:

preparing a second sheet (52), folding said second sheet (52) to form the duct extending along the prevalent development direction (Y), the outlet (5) being placed in the duct first longitudinal end (4*a*) while the opening (7) is placed substantially on a duct lateral wall at the second longitudinal end (4*b*) of the same, opposite to the first longitudinal end (4*a*), the duct prevalent development direction (Y) extending transversally, particularly normal, to the products (P) crossing direction (X).

In a 59th aspect according to anyone of the preceding aspects of process, wherein the step of preparing the delivery mechanism (8) comprises at least the following sub-steps:

forming the maneuvering organ (10) so that this latter extends from a first to a second longitudinal ends (10*a*, 10*b*), engaging, inside the volume of passage (4), said maneuvering organ (10) so that the first end (10*a*) of this latter is placed at the outlet (5) while the second end (10*b*) is placed at the opening (7), the maneuvering organ (10) engaging at the second end (10*b*), said shutter (9), the maneuvering organ (10) being configured for:

receiving at the first end, a thrust (S) directed along the duct prevalent development direction (Y), following the thrust (S), sliding inside the duct along the prevalent development direction (Y) of the same to exert a thrust on the first tab (12), following the sliding, warping, particularly elastically, the folded portion (11) for enabling to angularly approach or move away said tabs (12, 13) from each other and define the condition of passage of the delivery mechanism (8).

In a 60th aspect according to the preceding aspect, the step of forming the duct of the volume of passage (4) provides to form, at the duct itself second longitudinal end (4*b*), the bottom wall (4*c*) which faces the outlet (5) and is placed inside the door (6) opening (7), the step of preparing the delivery mechanism (8) further provides the following steps:

abutting, at least partially, the second tab (13) on the bottom wall (4*c*), engaging the first tab (12) with the maneuvering organ (10).

In a 61st aspect according to the aspect 59 or 60, the step of forming the duct of the volume of passage (4) provides to form, at the first end (4*a*), a recess (15) extending along the duct itself prevalent development direction (Y), said recess (15) being configured for enabling to thrust the maneuvering organ (10) inside the volume of passage, and wherein the recess (15) defines a through opening (16) at the container (1) lateral wall and delimited by a free edge (17) having a substantially "U" shape communicating with the outlet (5) of the volume of passage (4).

In a 62nd aspect according to anyone of the preceding aspects of process, the first tab (12) extends along a rectilinear direction from a first and second end edges (12*a*, 12*b*), the second tab (13) extends along a respective rectilinear direction from a first to a second end edges (13*a*, 13*b*), and wherein the first and second tabs (12, 13) are engaged with each other at the respective second end edges (12*b*, 13*b*).

In a 63rd aspect according to anyone of the preceding aspects of process, the first sheet (51) is made of paper material.

In a 64th aspect according to the preceding aspect, the first sheet (51) has a grammage comprised between 100 and 500 gr/m$^2$, in particular comprised between 300 and 400 gr/m$^2$.

In a 65th aspect according to anyone of the preceding aspects of process, the duct second sheet (52) of the volume of passage (4) is made of paper material.

In a 66th aspect according to the preceding aspect, the second sheet (52) exhibits a grammage comprised between 100 and 500 gr/m$^2$, particularly comprised between 300 and 400 gr/m$^2$.

In a 67th aspect according to anyone of the preceding aspects of process, the shutter (9) and maneuvering organ (10) are both made with the first sheet (51), particularly of paper, the first sheet (51) comprising at least one main portion (51*a*) and a connecting portion (51*b*), preparing the delivery mechanism (8) provides to fold the connecting portion (51*b*) to define said first and second tabs (12, 13).

In a 68th aspect according to the preceding aspect, the main portion (51*a*) comprises a flat sheet defining an outer perimeter having a substantially rectangular shape, and wherein the connecting portion (51*b*) comprises also a flat sheet defining a substantially rectangular-shaped outer perimeter, the connecting portion (51*b*) being integrally joined to the main portion (51*a*) at a corner of this latter.

In a 69th aspect according to anyone of the aspects from 57 to 68, the second sheet (52) comprises a flat body comprising at least one first, second and third portions (52*a*, 52*b*, 52*c*), each portion exhibits a substantially rectangular shape, the first and second portions (52*a*, 52*b*) are integrally joined at an interconnection longitudinal edge (55), the second and third portions (52*b*, 52*c*) are integrally joined at an interconnection longitudinal edge (56), the interconnection edge (55) of the first and second portions (52*a*, 52*b*) is opposite to the interconnection longitudinal edge (56) of the second and third portions (52*b*, 52*c*) with respect to the second portion itself, the process further comprising a step of preparing a third sheet (53) having a main flat body (57) exhibiting a substantially rectangular shape delimited by a lower edge (53*a*), a first and second lateral edges (53*a*, 53*b*) and an upper edge (53*d*), and wherein the process provides at least the following sub-steps:

folding, at the interconnection longitudinal edge (55), the first and second portions (52*a*, 52*b*) so that these latter define, according to a cross section, a substantially "L" shape, folding, at the longitudinal edge (56), the second and third portions (52*b*, 52*c*) so that these latter define, according to a cross section, a substantially "L" shape, the first, second and third portions (52*a*, 52*b*, 52*c*) defining, according to a cross section, a substantially "U" shape, placing the first, second and third portions (52*a*, 52*b*, 52*c*) folded on the main body (57) of the third sheet in order to define the duct of the volume of passage (4).

In a 70th aspect according to the preceding aspect, the third portion (52*c*) of the second sheet (52) comprises an opening (58) which, in the folded configuration of the second sheet (52) itself, is apt to define the opening (7) of the volume of passage (4).

In a 71st aspect according to the preceding aspect, the opening (58) is delimited at a free edge (59) defining a substantially "U" shape, the concavity thereof is placed opposite to the third portion (52*c*) itself.

In a 72nd aspect according to anyone of the aspects from 57 to 71, the second sheet (52) further comprises a fourth portion (52*d*) connected to the third portion (52*c*) at an interconnection longitudinal edge (60), the process further providing the following sub-steps:

folding, at the interconnection longitudinal edge (60), the third and fourth portions (52*c*, 52*d*) so that these latter define, according to a cross section, a substantially "L" shape, the concavity thereof is opposite to the volume of passage (4), placing the delivery mechanism (8) on the third sheet (53) so that the first sheet (51) main body (51*a*) abuts on the third sheet (53) main body (57) while the folded portion (11) exhibits, according to a cross section, a "V" shape the concavity thereof faces the third sheet (53) main body (57), placing the second sheet (52) on the third sheet (53) so that the second sheet (52) duct internally houses the shutter (9) folded portion (11), the folded portion (11) being interposed between the second portion (52*b*) of second sheet (52) and the third sheet (53) main body (57), the fourth portion (52*d*) of the second sheet (52) abutting on at least part of the maneuvering organ (10).

In a 73rd aspect according to anyone of the preceding aspects of process, wherein said process comprises at least one step of preparing a fourth flat sheet (54) comprising at least one main body (54*a*) and a connecting portion (54*b*) both exhibiting a substantially rectangular shape, said portions (54*a*, 54*b*) exhibiting an interconnection longitudinal edge (61), and wherein the process provides at least the following sub-steps:

folding the main body (54*a*) and connecting portion (54*b*) of the fourth sheet (54) at the interconnection longitudinal edge (61) to define, according to a cross section, a substantially "L" shape, after placing the first and second sheets (51, 52) on the third sheet (53), placing the fourth sheet (54) on the second sheet (52), the second, third and fourth sheets (52, 53, 54) defining the compartment (2) and also the container (1) lateral walls.

In a 74th aspect according to the preceding aspect, the first, second, third and fourth sheets (51, 52, 53, 54) are integrally joined to define a single sheet.

In a 75th aspect according to the preceding aspect, the first sheet (51) connecting portion (51*b*) is integrally joined to the third sheet (53) lower edge (53*a*), and wherein the first lateral edge (53*b*) of the third sheet (53) is integrally joined to a longitudinal edge of the second sheet (52) first portion (52*a*), and wherein second lateral edge (53*c*) of the third sheet (53) is integrally joined to a longitudinal edge of the fourth sheet (54) connecting portion (52*b*).

In a 76th aspect according to anyone of the aspects from 57 to 75, the step of preparing the second sheet (52) comprises at least a step of cutting the main body (57) at the corner between the first lateral edge (53*a*) and the upper edge (53*d*), the cutting step defining a through opening (62) apt to define the container (1) recess (15).

In a 77th aspect according to anyone of the aspects from 72 to 76, the second sheet (52) comprises at least one connecting portion (63) integrally joined to the first portion (52*a*) and longitudinally emerging from this latter, and wherein the fourth sheet (54) comprises at least one lower abutment portion (64) integrally joined to a main body (54) lower edge (54*c*) and longitudinally emerging from this latter, the fourth sheet further comprising a connecting portion (63) integrally joined to a connecting portion (54*b*) lower edge of the fourth sheet (54) and longitudinally emerging from this latter, the connecting portion (63) emerging from the same side of the lower abutment portion (64), the process further providing the following steps:

folding the lower abutment portion (64) towards the fourth sheet (54) main body (54*a*), following positioning the fourth sheet (54) on the second sheet (52), engaging the connecting portion (63) of the fourth sheet (54) with the abutment portion of the same for holding the abutment portion in the folded configuration, following positioning the fourth sheet (54) on the second sheet (52), engaging the connecting portion (63) of the second sheet (52) with the lower abutment portion (64) of the fourth sheet (54) for ensuring the engagement of the second and fourth sheets (52, 54).

In a 78th aspect according to anyone of the aspects from 73 to 77, the fourth sheet (54) comprises at least one upper abutment portion (65) integrally joined to a main body (54*c*) upper edge (54*d*) and longitudinally emerging from this latter, the fourth sheet further comprising a connecting portion (63) integrally joined to an upper edge of the connecting portion (54*b*) of the fourth sheet (54) and longitudinally emerging from this latter, the connecting portion (63) emerging from the same side of the upper abutment portion (65), the process further providing the following steps:

folding the upper abutment portion (65) towards the fourth sheet (54) main body (54*a*), after positioning the fourth sheet (54) on the second sheet (52), engaging the connecting portion (63) of the fourth sheet (54) to the upper abutment portion of the same for holding the abutment portion itself in the folded configuration.

In a 79th aspect according to the preceding aspect, the fourth sheet (54) comprises, at an upper edge (54*d*), a closing portion (66) comprising at least one first and at least one second portions (67, 68) integrally joined by an interconnection longitudinal edge (69), the closing portion (66) defining at least part of the upper abutment portion (65) and being integrally joined to this latter by a tear longitudinal edge (70), and wherein the process further comprises at least the following sub-steps:

folding, at the fourth sheet (54) upper edge (54*d*), the closing portion (66) towards the lower abutment portion (64), folding, substantially at an intermediate tracing (71), the first and second portions (67, 68) towards the lower abutment portion (64), the first and second folded portions (67, 68) define, according to a cross section, a substantially "L" shape, the first portion being configured for contacting the third sheet (53) main body (57) while the second portion (68) is configured for contacting the second sheet (52) first portion (52*a*), folding the second portion (68) towards the first portion (67), stably engaging said first and second folded portions for defining said closing element (18).

BRIEF DESCRIPTION OF THE DRAWINGS

Some embodiments and some aspects of the invention will be described in the following with reference to the attached drawings, provided only in an indicative and therefore non limiting way, wherein:

FIG. 4 is a detailed perspective view of a delivery mechanism of a container according to the present invention;

FIG. 5 is a detailed perspective view of the delivery mechanism of the container arranged in an operative condition;

DETAILED DESCRIPTION

Container

1 generally indicates a container or dispenser for delivering a prefixed number of products P at a time, particularly for delivering only one product P at a time. The present description will not specify the type of deliverable products P because such container 1 can be used for defining portable dispensers adapted to house/deliver different kind of products. For example, the container 1 can find an application in the confectionery field for dispensing candies, mini chocolates and/or chewing-guns. A further field of application can be represented by the pharmaceutical and cosmetic fields; de facto, the container can be used for delivering also tablets and/or pills. However, the above cited examples are considered in a non limiting way because the container 1, object of the present invention, can find an advantageous application in all the fields providing to deliver, from a portable dispenser, a prefixed number of products; the products P can also comprise, in a non limiting way, cigarettes.

Figure 1:
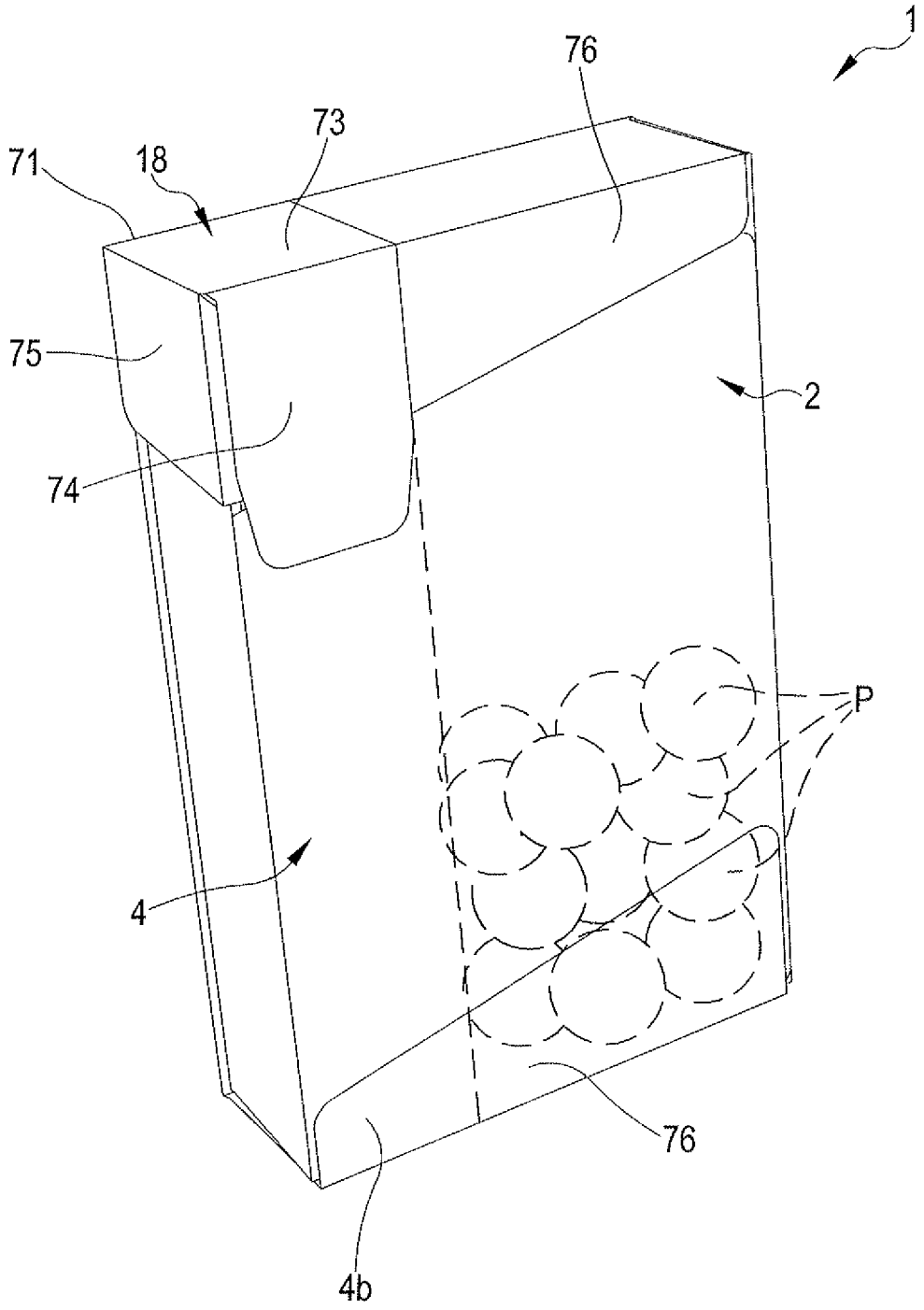
FIG. 1 is a perspective view of a container according to the present invention.
Figure 2:
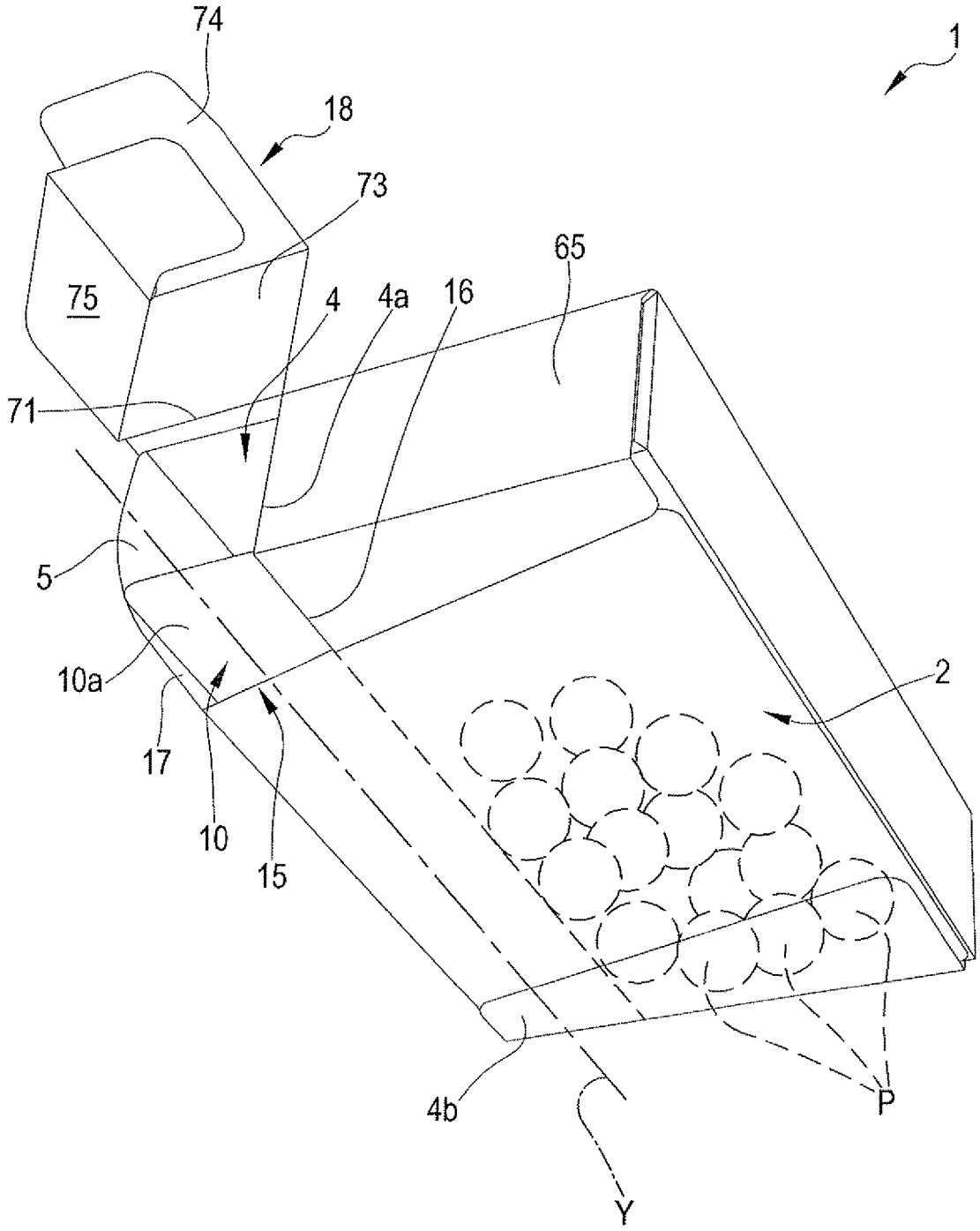
FIG. 2 is a further perspective view of a container according to the present invention.
Figure 3:
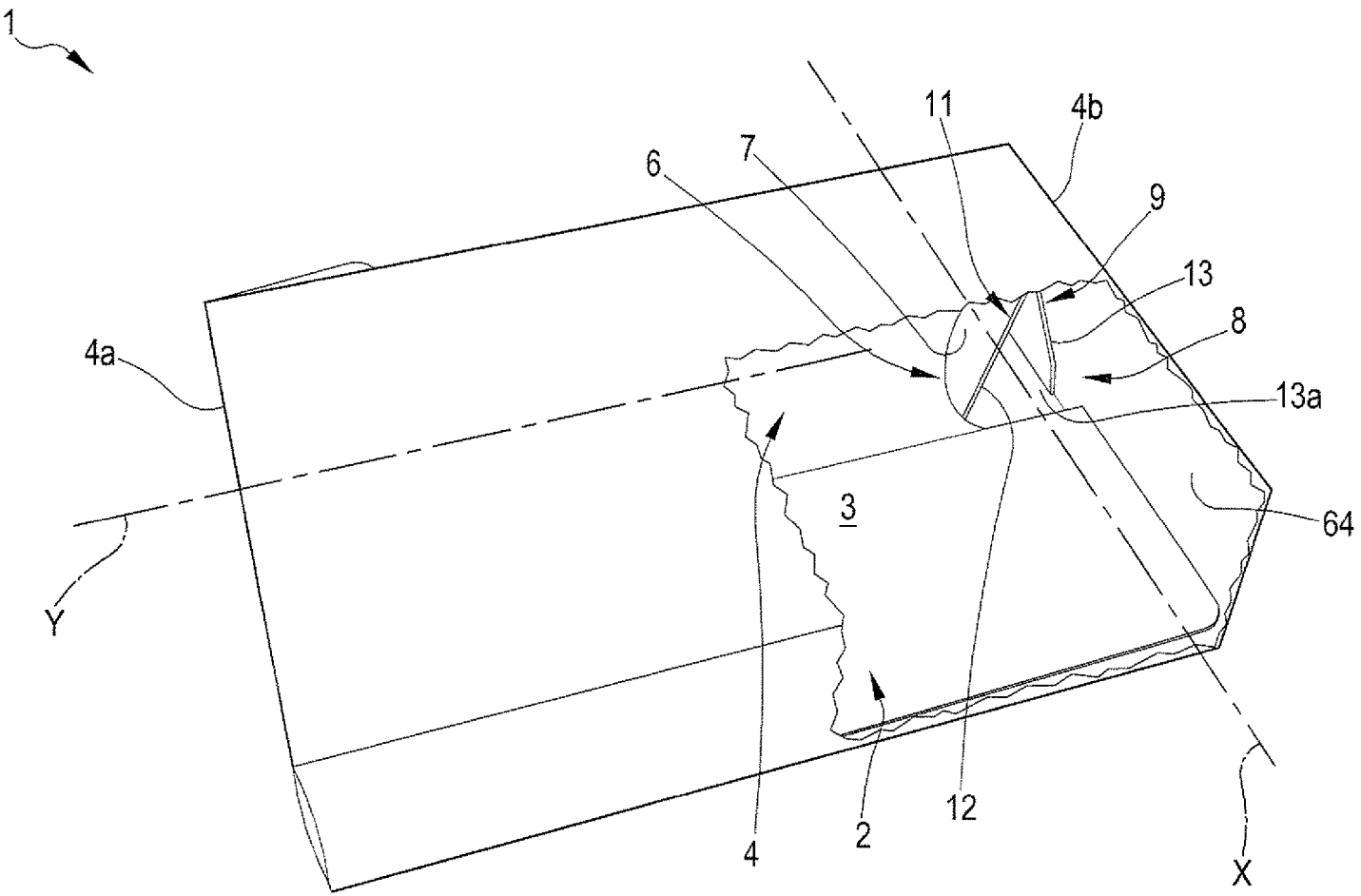
FIG. 3 is a cut-away of a container according to the present invention arranged in a closing condition.

As it is visible for example in FIGS. 1-3, the container 1 comprises at least one compartment 2 defining an inner volume 3 configured for housing a plurality of products P. The compartment 2 substantially represents the container 1 compartment adapted to house and support the plurality of products P before delivering these latter. The attached figures illustrate a non limiting configuration of the compartment 2 which exhibits a prismatic rectangular shape; however, it is not excluded the possibility of making a compartment of a different shape, for example trapezoidal or cylindrical.

As it is visible, the compartment 2 extends, in a non limiting way, substantially along a prevalent development direction and exhibits a thickness lower than the length and width of the same. The compartment 2 is configured for exhibiting a minimum size, in this case, the thickness, greater than a transversal maximum size of each product P; the compartment 2 minimum size is, in a non limiting way, greater than 7 mm (the thickness S can vary and be suitably sized based on the product P and the quantity to deliver). Generally, the compartment 2 defines an inner volume greater than 20,000 $mm^3$, particularly comprised between 40,000 and 100,000 $mm^3$. Advantageously, the compartment 2 is made of sheet material and is obtained by folding. In a preferred but non limiting embodiment of the invention, the compartment 2 is made of paper sheet material (paper or paperboard); particularly, the used sheet material exhibits a grammage comprised between 100 and 500 $gr/m^2$, particularly comprised between 200 and 400 $gr/m^2$. As above described, the container, specifically the compartment 2, can also be used for housing food or pharmaceutical and cosmetic products. Under such condition, it is advantageous to cover a compartment 2 inner surface by a plastic material coating, for example a film. The object of the coating is to define a barrier interposed between the compartment 2 and the plurality of products P; further, the coating is adapted to define a water and/or humidity barriers useful for avoiding the weakening and loss of structurality with consequent warping of the paper material forming the compartment 2. Advantageously, the coating can be an extrusion coating on one (compartment 2 inner side) or both the sides (inner and outer surfaces of the compartment 2) of the paper material defining the compartment 2 with values which can, for example, vary between 10 and 50 gr/m$^2$ of the coating material (in other words polyethylene). The coating plastic material can be for example selected among the following materials: LDPE, HDPE, PP, PE.

Figure 6:
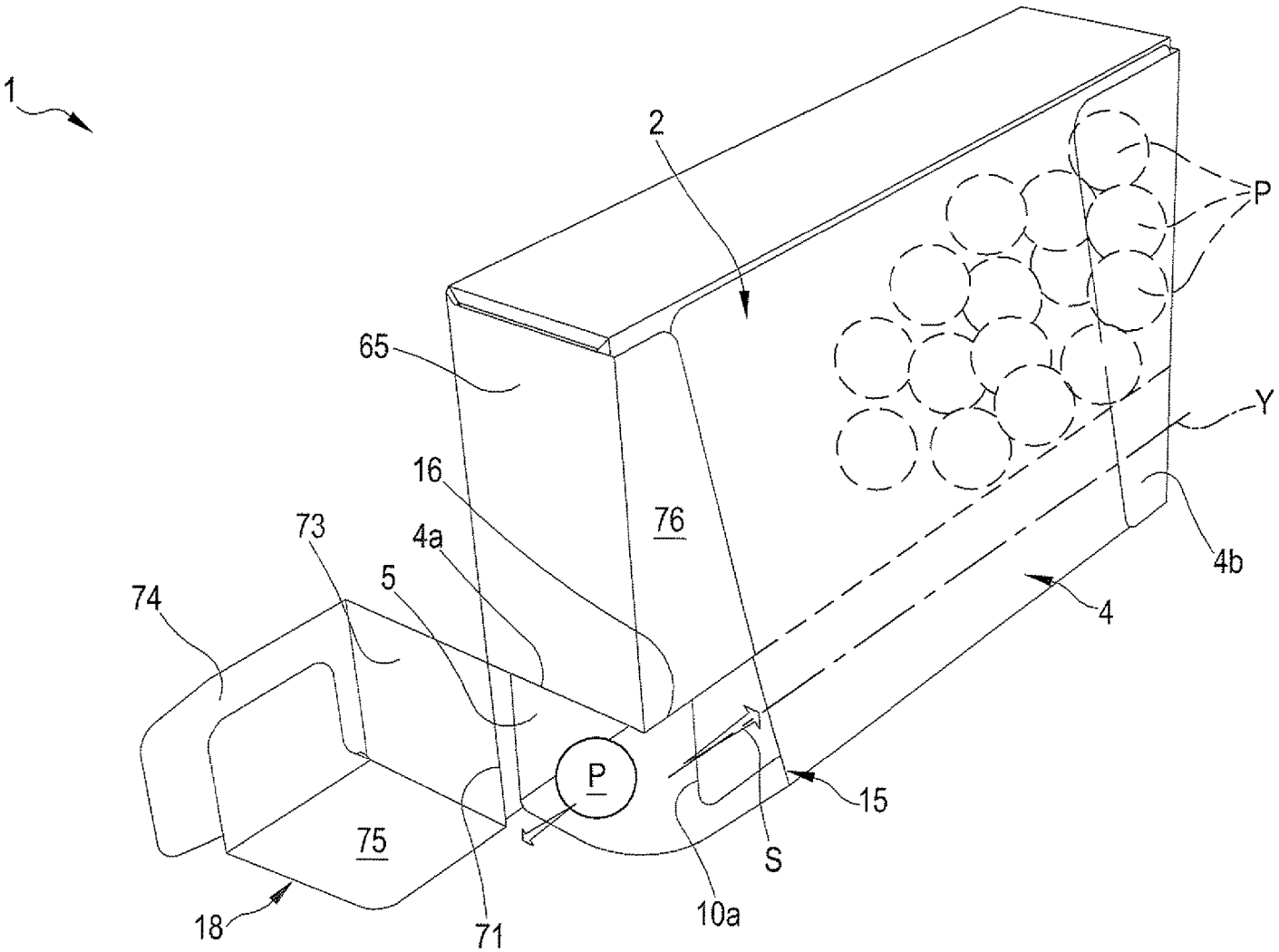
FIG. 6 is a perspective view of a container according to the present invention arranged in a condition of passage.

As it is visible in FIGS. 2, 3 and 6, the container 1 comprises at least a volume of passage 4 exhibiting at least one outlet 5 configured for enabling to supply the products P outside the container 1. The volume of passage 4 is substantially configured for receiving one or plural products P from the compartment 2 and guiding them towards the outlet 5 for enabling to deliver them towards the outer environment. The volume of passage 4 substantially comprises a duct extending along a prevalent development direction Y (see for example FIG. 3) and flanking the compartment 2. In a preferred but non limiting embodiment of the invention, the volume of passage 4 is integrally joined to the compartment 2 to form a single detail; in such condition, the duct and compartment advantageously share the same partition lateral wall.

The duct of the volume of passage 4 extends beside the compartment 2, parallelly to the prevalent development direction of this latter, between a first and second ends 4*a*, 4*b*; the outlet 5 of the volume of passage is placed at the first end 4*a* (FIG. 2). As it is visible for example in FIGS. 2 and 6, the duct of the volume of passage 4 comprises, at the first end 4*a*, a recess 15 extending along the duct prevalent development direction Y; the recess 15 defines a cut crossing the duct lateral wall which fluidically communicates the duct inner volume with the outer environment. More specifically, the recess 15 defines a through opening 16 at a container 1 lateral wall and delimited by a free edge 17 having a substantially "U" shape communicating with the outlet 5 of the volume of passage 4. The free edge 16 substantially defines a duct perimetral edge portion: the concavity of the "U" shape of the free edge 16 faces away from the duct second end 4*b* (FIGS. 2 and 6).

More particularly, the duct flanks the compartment 2 so that a duct lateral wall directly contacts a compartment 2 lateral wall. From the geometrical point of view, the duct exhibits, in a non limiting way, a square prismatic shape; de facto, according to the duct cross section (section normal to the prevalent development direction Y), the duct defines a substantially square or rectangular shape. However, the duct can exhibit several shapes, for example a circular cross section tubular, elliptical, diamond or trapezoidal shapes (these configurations are not illustrated in the attached figures).

Instead, with reference to the dimensional aspect of the volume of passage 4, this latter defines an area of passage (surface extension of the duct cross section) greater than 200 mm$^2$, particularly comprised between 250 and 500 mm$^2$. Besides such area (area of passage of the products P through the duct) it is possible to evaluate the duct minimum transversal size, measured normal to the development direction Y of the same, which is greater than 10 mm, particularly is comprised between 15 and 25 mm. The duct minimum size is in this case representative, in a non limiting way, of the duct thickness; the duct minimum size—as the compartment 2 minimum size—is configured for granting the passage (sliding) of the products P inside the volume of passage 4, therefore, this latter must be greater than a maximum transversal size of the products P. The attached figures illustrate only ducts of prismatic shape; however, it is not excluded the possibility of making ducts of a different shape, for example tubular, cylindrical, elliptical, trapezoidal or diamond shape.

Advantageously, but in a non limiting way, the inner volume defined by the duct is smaller than the compartment 2 inner volume, because the volume 4 is only adapted to enable only one product at a time to exit; de facto, the duct inner volume is greater than 20,000 mm$^3$, particularly is comprised between 30,000 and 80,000 mm$^3$. It is possible to evaluate the duct inner volume also by the ratio of the compartment 2 inner volume; de facto, the ratio of the compartment 2 volume to the duct volume is greater than 1.5, particularly is comprised between 2 and 4.

Advantageously, also the volume of passage 4, as for the compartment 2, is made of sheet material and is obtained by folding. In a preferred but non limiting embodiment of the invention, the volume of passage 4 (duct) is made of paper sheet material (paper or paperboard); particularly, the paper sheet material used for making the volume 4 exhibits the same characteristics of paper/paperboard used for making the compartment 2. As hereinbefore described, in a preferred embodiment of the invention, the volume of passage 4 is integrally joined to the compartment 2, in such configuration the sheet material used for making this latter is the same as the one used for forming the duct because of the definition of only one integrally joined detail.

The used paper sheet material can exhibit a grammage comprised between 150 and 400 gr/m$^2$, particularly comprised between 200 and 300 gr/m$^2$. As hereinbefore discussed, the container 1 can also be used for housing food products or products of the pharmaceutical and cosmetic fields. In such condition, it is advantageous to cover a duct inner surface by a plastic material coating, for example a film. The object of the coating is to define a barrier adapted to prevent the products to contact the paper material; further, the film defines a water and/or humidity barriers useful for avoiding the weakening and the loss of structurality with subsequent warping of the paper material forming the duct. Advantageously, it is possible to define an extrusion coating on one (duct inner side) or on both sides (duct inner and outer surfaces) of the paper material defining the volume of passage 4 with values which can for example vary between 10 and 50 gr/m$^2$ of coating material (in other words polyethylene). The coating plastic material can be for example selected among the following materials: LDPE, HDPE, PP, PE.

It is possible to observe in the attached figures (for example FIGS. 3-5), that the container 1 further comprises a door 6 defining an opening 7 configured for communicating the compartment 2 with the volume of passage 4. De facto, the opening 7 comprises a passage placed, in a non limiting way, substantially at the second end 4*b* of the volume of passage 4; the passage (opening) is defined on one or more of the partition lateral walls of the compartment 2 and duct: it extends along a crossing direction X of the products P for enabling the fluid communication between the compartment 2 inner volume 3 and the volume of passage 4. As it is visible, the crossing direction X is transversal, particularly normal, to the prevalent development direction Y of the volume of passage 4.

From the geometrical point of view, the opening 7 is perimetrally delimited by an edge having a substantially rectangular or square shape. The attached figures illustrate a preferred but non limiting configuration of the invention in which the opening 7 edge exhibits at least one side, particularly the side facing the volume 4 first end 4*a*, curvilinear, particularly an arc or circle (see for example FIGS. 3-5). Despite it has been shown only one configuration of the door 6 placed at the duct second end 4*b*, and exhibiting a substantially square shape, it is not excluded the possibility of forming an opening 7 in different positions of the duct (placed at the centerline of the duct or at the first end 4*a*) and/or having a shape different from the represented one, for example defining a circular, elliptical, diamond or trapezoidal shape (these configurations are not illustrated).

With reference to the door 6 dimensional point of view (which is defined in an illustratively way since the sizes of the container and also of the door are completely variable because they are a function of the article to be delivered), it is possible to define a prefixed area of passage of the opening 7 which is comprised between 100 and 600 $mm^2$, particularly between 300 and 400 $mm^2$. It is further possible to define a minimum passage size of the opening 7 which is greater than 7 mm, particularly is comprised between 15 and 25 mm. The minimum passage size is defined by the minimum distance between two facing points of the opening 7 perimetral edge and it is advantageously greater than the transversal maximum size of the products P.

As it is visible for example in FIGS. 1, 2 and 6, the container 1 further comprises at least one closing element 18 engaged with the volume of passage 4 and/or with the compartment 2; said closing element 18 is, in a non limiting way, placed at the outlet 5 outside the volume of passage 4 and outside the compartment 2. The closing element 18 is configured for being arranged in a condition of passage in which the element 18 itself enables to deliver the products P from the outlet 5 (FIG. 2); further the closing element 18 is configured for being arranged in a locking condition wherein the element 18 itself closes the outlet 5 and interdicts the products P delivery from this latter (FIG. 1). In the illustrated embodiment, the closing element 18 is, in a non limiting way, constrained to the duct at an outlet 5 free edge and opposite to the recess 15. More particularly, the closing element 18 and the duct are integrally joined and engaged by an interconnection perimetral edge 72 (FIGS. 2 and 6); the closing element 18 is configured for rotating with respect to the duct around the edge 72 for switching from the condition of passage to the closing condition, and viceversa. Also in the condition wherein there is one or plural products inside the volume of passage 4, ready to be delivered, the closing element 18, in the locking condition, prevents the passage through the outlet 5. More specifically, the closing element 18 comprises at least one first wall 73 engaged with the duct and exhibiting a surface extension equal to or greater than the area of passage of the outlet 5. The first wall 73 is substantially countershaped to the outlet 5 and defines the element directly configured for interdicting the passage of products P during the locking condition of said element 18. Further, the closing element 18 comprises a second wall 74 integrally joined to the first wall 73 and emerging transversally, particularly normal, to the first wall 73 to substantially define a "L" element. The second wall 74 is configured for facing, during the element 18 locking condition, the recess 15. Further, the second wall 74 is configured for entering, at least partially, inside the recess 15 for stably holding the element 18 in the locking condition. Advantageously, the closing element 18 further comprises a third wall 75 emerging transversally, particularly normal, to the first and second walls 73, 74; the third wall 75 is configured for facing a duct lateral wall immediately adjacent the recess 15; the third wall 75 is further configured for guiding and supporting the movement of the element 18 when switches from the passage condition to the locking one, and viceversa. As it is visible in the attached figures, the walls 73, 74 and 75 emerge transversally to each other on approach to each other to define a housing cavity; in the passage condition of the closing element 18, this latter is configured for receiving the products P exiting the volume of passage 4 and prevents them from dropping: the housing cavity is configured for substantially acting as an element gripping the products P exiting the volume of passage 4 (FIG. 6). In a preferred but non limiting configuration of the invention, the walls 73, 74 and 75 are integrally joined to define a single body, particularly are integrally joined to the volume of passage 4 (duct) to define with this latter a single piece.

Advantageously, also the closing element 18, as for the compartment 2 and/or the volume of passage 4, is made of sheet material and is obtained by folding. In a preferred but non limiting embodiment of the invention, also the closing element 18 is made of paper sheet (paper or paperboard); particularly, the paper sheet material used for making the element 18 exhibits the same characteristics as the paper/paperboard used for making the compartment 2 and/or volume of passage 4. As hereinbefore described, in a preferred embodiment of the invention, the closing element 18 is integrally joined to the duct and/or compartment 2; the sheet material used for making the compartment 2 and/or duct is the same sheet used for forming the closing element 18: in this way said closing element 18 is integrally joined to the duct and/or compartment. Advantageously the compartment 2, volume of passage 4 and closing element 18 are made of the same paper material sheet to define a single integrally joined detail.

As hereinbefore described, the container 1 can be also used for housing food products or pharmaceutical and cosmetic products. In such condition, it is advantageous to cover an inner surface of the element by a plastic material coating, for example a film. The coating has the object of defining a barrier adapted to prevent the contact of the products with the paper material; the film further defines a water and/or humidity barriers useful for avoiding the weakening and the loss of structurality with subsequent warping of the paper material forming the element 18. Advantageously, it is possible to define an extrusion coating on one (the inner side facing the compartment 2 inner volume 3) or both the sides (inner and outer surfaces) of the paper material defining the closing element 18 with values which can for example vary between 10 and 50 $gr/m^2$ of coating material (in other words polyethylene). The coating plastic material can be for example selected among the following materials: LDPE, HDPE, PP, PE.

As it is visible in the attached figures, the container 1 further comprises at least one delivery mechanism 8 engaged at least partially inside the volume of passage 4 and/or inner volume 3 of the compartment 2, at the door 6. The delivery mechanism 8 is configured for managing the passage of products P through the opening 7. Specifically, the delivery mechanism 8 is configured for being placed at least in a closed condition in which the mechanism itself prevents the passage of products P through the door 6; the delivery mechanism 8 is further configured for being placed at least in a condition of passage in which the mechanism itself enables the passage of one or plural products P through the door 6 to enable therefore the products P to exit the compartment 2. More particularly, the delivery mechanism 8 comprises at least one shutter 9 (see for example FIG. 3) placed at the door 6 and apt to define, in cooperation with the opening 7, a prefixed section of passage: the shutter 9, in the closing condition, defines a section of passage apt to interdict the passage of products P while, in the passage condition, the shutter 9 defines a section of passage apt to enable the passage of the products P. quantitatively, the section of passage, defined by the cooperation between the shutter 9 and opening 7, exhibits a surface extension comprised between 5 and 250 $mm^2$, particularly between 150 and 250 $mm^2$. De facto, the ratio of the area of passage defined by the opening 7 and the section of passage defined by the cooperation between the shutter 9 and opening 7, is equal to or greater than 2, particularly is comprised between 2 and 5.

In addition, the mechanism 8 comprises at least one maneuvering organ 10 (see for example FIG. 3) active on the shutter 9 for commanding the closing and passage conditions of the delivery mechanism 8; the maneuvering organ will be better described hereinbelow. With reference to the shutter 9, this latter comprises an elastic body configured for holding the shutter 9 itself in the closing condition: the elastic body is configured for automatically moving the shutter 9 to the closed condition from the passage condition. As it is possible to observe in the attached figures, the shutter 9 defines both the opening and obstructing element of the opening 7 and the spring-back element capable of moving the shutter 9 itself to a normally closed condition. In the embodiment illustrated in the attached figures, the shutter 9 is advantageously engaged inside the volume of passage 4 at the duct second end 4*b*: the shutter 9 fully faces the opening 7. More particularly, it is possible to observe that the shutter 9 is at least partially—particularly completely—made of sheet material and has a folded portion 11 which directly defines both the obstructing and opening body of the door 6 and the spring back body of the shutter 9 itself.

As it is visible for example in FIGS. 3-5, the folded portion 11 comprises a first and second tabs 12, 13 (FIGS. 3-5) facing the opening 7 and longitudinally extending away from this latter substantially parallelly to the products crossing direction X (FIG. 3). De facto, the first and second tabs 12, 13 extend transversally, particularly normal, to the duct prevalent development direction Y, particularly from the opening 7 to a duct lateral wall opposite to said opening 7. In other words, the first and second tabs 12, 13 extend between respective longitudinal edges, one of them faces the door 6 opening 7.

As it is visible in the attached figures, the first tab 12 is directly connected to the maneuvering organ 10 and faces the outlet 5, while the second tab 13 is connected to the first tab 12, facing a duct bottom wall 4*c*, opposite to the outlet 5. From the geometrical point of view, the first tab 12 extends along a rectilinear direction from a first to a second end edges 12*a*, 12*b*; the first end edge 12*a* of the first tab 12 is directly engaged with the maneuvering organ 10 while the second end edge 12*b* is engaged with the second tab 13. Also the second tab 13 extends along a respective rectilinear direction from a first to a second end edges 13*a*, 13*b*; the first end edge 13*a* of the second tab 13 abuts on the duct bottom wall 4*c*, while the second end edge 13*b* is engaged with the second end edge 12*b* of the first tab 12. Substantially, the first and second tabs 12, 13 are engaged with each other at the respective second end edges 12*b*, 13*b* (FIG. 5). De facto, each tab 12, 13 comprises a sheet having, in a non limiting way, a rectangular or square shape. From the dimensional point of view, the first tab 12 exhibits a prefixed length comprised between 15 and 25 mm, particularly between 18 and 22; the length of the first tab 12 is defined by the maximum distance between the first and second end edges 12*a*, 12*b* of the tab itself. The second tab 13 has also a prefixed length comprised between 16 and 30 mm, particularly between 20 and 26 mm; the second tab 13 length is defined by the maximum distance between the first and second end edges 13*a*, 13*b* of the tab itself. Advantageously, the ratio of the second tab 13 length to the first tab 12 length is equal to or greater than 1.1, particularly is comprised between 1.15 and 1.2.

As hereinbefore described, the folded portion 11 is configured for being normally arranged in a normally closed condition (shutter 9 closed condition); in such condition, the tabs 12, 13 are normally placed in a condition wherein they are angularly spaced from each other for defining the mechanism 8 closing condition. More particularly, in such a condition, the first end edges 12*a*, 13*a* respectively of the first and second tabs 12, 13 are spaced from each other; in such condition, the tabs 12 and 13 define, according to section transversal to the longitudinal development direction thereof, a substantially "V" shape arranged for obstructing the passage of the products P from the opening 7. Still more particularly, the first and second tabs 12, 13, in the shutter 9 closed condition, exhibit an angular offset inside the two tabs 12, 13 comprised between 10° and 35°, particularly between 15° and 25°.

Figure 7:
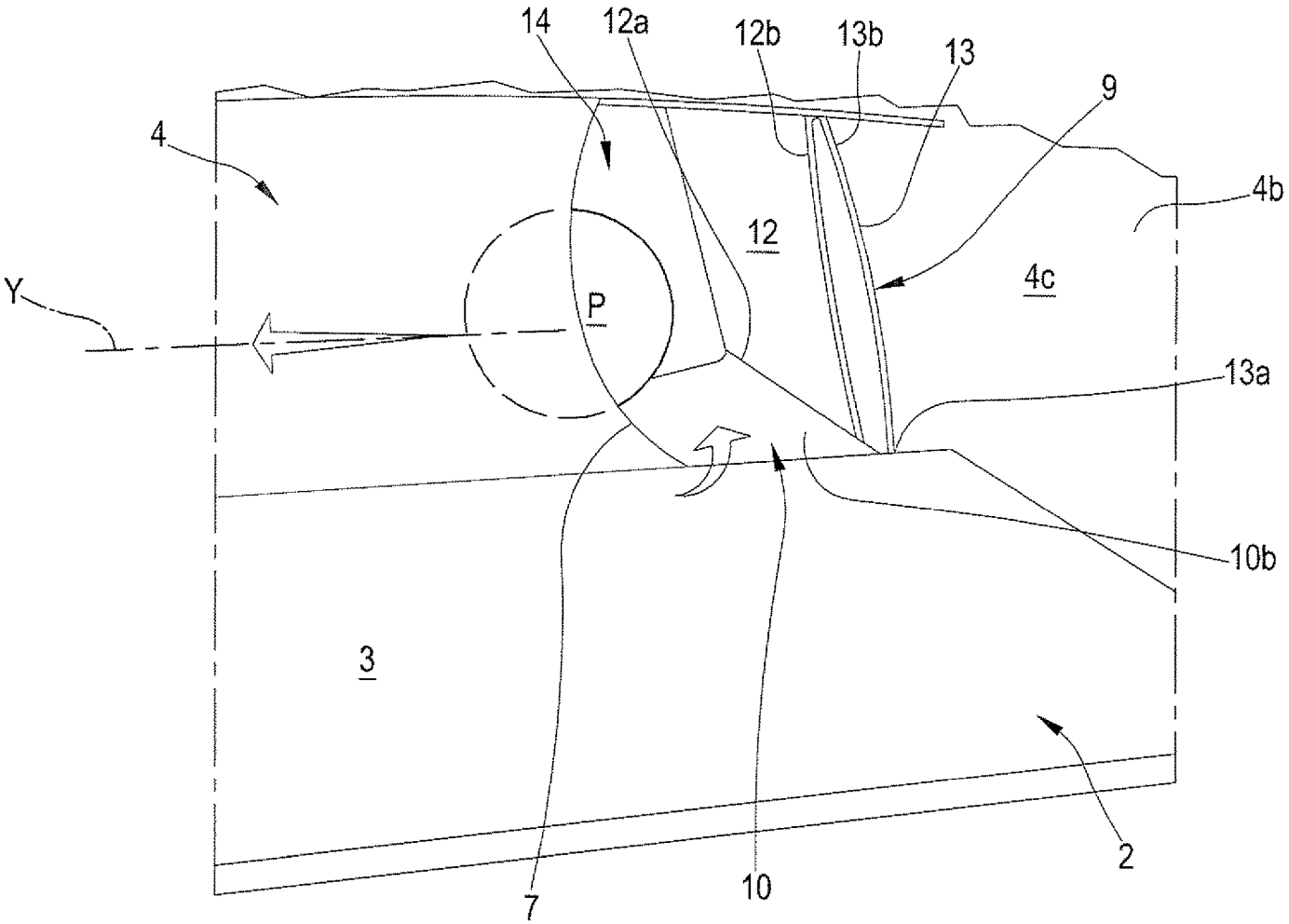
FIG. 7 is a detailed perspective view of the delivery mechanism of the container arranged in a condition of passage.

As hereinbefore described, the folded portion 11 is configured for elastically warping for defining the condition of passage of the mechanism 8 (FIG. 7); in such condition, the first and second tabs 12, 13 are arranged in an approached condition making them substantially to face each other (FIG. 7). In such configuration, the first end edges 12*a*, 13*a* of the respective tabs 12, 13 are close to each other, particularly are at least partially in contact.

It is observed that thanks to the folded portion 11 structure, in cooperation with the door 6, it is possible to define, in the delivery mechanism 8 closing condition, a housing seat 14 configured for holding only one product P (FIG. 5); the housing seat 14 is configured for substantially defining a dosing chamber which, in the delivery mechanism 8 passage condition, enables at least to deliver the product P held in the housing seat 14. More particularly, the first tab 12 (specifically the longitudinal edge facing the door 6), in the delivery mechanism 8 closing condition, in cooperation with the opening 7 perimetral edge, defines said housing seat 14. The first tab 12, during the switching from the passage condition to the closed one, is configured for approaching the second tab 13 for defining said passage condition and enabling to deliver the product P placed in the housing seat 14 (FIG. 7).

In a preferred but non limiting embodiment of the invention, the folded portion 11, and particularly the first and second tabs 12, 13, is made of paper sheet material (paper or paperboard) and is obtained by folding; particularly, the paper sheet material used for making the portion 11 exhibits the same characteristics as the paper sheet material used for making the compartment 2 and/or the duct. In a preferred embodiment of the invention, also the folded portion 11 is integrally joined to the compartment 2 and/or with the duct; in such configuration, the sheet material used for making said portion 11 is the same used for forming the duct and/or compartment for defining only one integrally joined detail.

The paper sheet material used for the portion 11 can exhibit a grammage comprised between 150 and 400 $gr/m^2$, particularly comprised between 200 and 300 $gr/m^2$. As hereinbefore described, the container 1 can also be used for housing food products or pharmaceutical and cosmetic products. In such condition, it is advantageous to cover at least part of the portion 11 with a plastic material coating, for example a film. The coating has the object of defining a barrier adapted to prevent the contact of the products with the paper material; the film further defines a water and/or humidity barriers useful for avoiding the weakening and the loss of structurality of the portion 11, and also the elastic characteristics useful for enabling the automatic spring back of the folded portion itself. Advantageously, it is possible to define an extrusion coating on one or both the paper material sides defining the folded portion 11 with values which can for example vary from 10 to 50 gr/m$^2$ of the coating material (in other words polyethylene). The coating plastic material can be for example selected among the following materials: LDPE, HDPE, PP, PE.

Instead, with reference to the maneuvering organ 10, this latter is engaged inside the duct and extends from a first end 10*a*, located at the outlet 5, to a second end 10*b* connected to the first tab 12 and placed at the opening 7. The maneuvering organ 10 is configured for receiving, at the first end 10*a*, a thrust S (FIG. 6) directed along the duct prevalent development direction Y; due to the thrust S, the maneuvering organ 10 is configured for sliding inside the duct along the prevalent development direction Y of the same to exert a thrust on the first tab 12. Following the sliding, the maneuvering organ 10 is configured for elastically warping the folded portion 11 for enabling to angularly approach the tabs 12, 13 and defining the delivery mechanism 8 passage condition.

More specifically, the maneuvering organ 10 exhibits a prevalent development direction which, in the engagement condition between the organ 10 and volume of passage, is substantially parallel to the duct development direction Y. As it is for example visible in FIG. 4, the maneuvering organ 10 second end 10*b* is directly connected to the first end edge 12*a* of the first tab 12; the maneuvering organ 10 thrust S therefore forcedly act on the thirst end edge 12*a* of the first tab 12, which, following such action, substantially rotates around the second end edge 12*b* of the same (therefore around the second end edge 13*b* of the second tab 13) for approaching the tab 13.

As it is visible in FIGS. 2 and 6, the maneuvering organ 10 extends to the duct first end 4*a*; advantageously, the maneuvering organ 10 first end 10*a* exhibits at least one thrust portion placed on the same side of the recess 15, and longitudinally projects with respect to this latter (FIG. 2). De facto, the maneuvering organ 10 first end 10*a* is configured for facing the recess 15 in the mechanism closed condition; in such condition, the maneuvering organ 10 can be reached from the outside and is displaceable along the duct development direction Y: the organ 10 movement enables to activate the shutter 9 for bringing it in the passage condition. De facto, the recess 15 is configured for enabling to activate the maneuvering organ 10 by the thrust on the same at the first end 10*a*; the defined depth of the recess 15 is such to enable to correctly warp the folded portion 11 and therefore the passage of one or plural products P from the opening 7 (FIGS. 6 and 7).

In a preferred but non limiting embodiment of the invention, the maneuvering organ 10 is also made of sheet material and exhibits, again in a non limiting way, a rectangular shape: a sheet end edge is engaged with the tab 12 first end edge 12*a*. Advantageously, the sheet abuts on and is guided on the lateral wall of the duct carrying the recess 15 as clearly illustrated in FIGS. 2 and 6. Advantageously, the delivery mechanism 8 is a single piece; in such condition, the maneuvering organ 10 is integrally joined to the shutter 9 to define a single detail.

In a preferred but non limiting embodiment of the invention, the maneuvering organ 10 is made of paper sheet material (paper or paperboard); particularly, the paper sheet material used for making the maneuvering organ 10 exhibits the same characteristics as the paper sheet material used for making the shutter 9. As hereinbefore described, in a preferred embodiment of the invention, the maneuvering organ 10 is integrally joined to the shutter 9; in such configuration, the sheet material used for making said organ 10 is the same as the one used for forming the shutter 9 for defining a single integrally joined detail.

However, it is possible to obtain at least two preferred configurations of the invention. In a first configuration, the maneuvering organ 10 and shutter 9 are integrally joined to but distinct from the other container 1 components (compartment 2, volume of passage 4 and closing element 18). In a second configuration, all the container details (shutter 9, maneuvering organ 10, compartment 2, volume of passage 4 and closing element 18) are integrally joined to define a container 1 made from a single sheet, particularly a single sheet of paper material.

The paper sheet material used for the maneuvering organ 10 can exhibit a grammage comprised between 150 and 400 gr/m$^2$, particularly comprised between 200 and 300 gr/m$^2$. As hereinbefore described, the container 1 can also be used for housing food products or pharmaceutical and cosmetic products. In such condition, it is advantageous to cover at least part of the maneuvering organ 10 with a plastic material coating, for example a film. The coating has the object of defining a barrier adapted to prevent the contact of the products with the paper material; the film further defines a water and/or humidity barriers useful for avoiding the weakening and the loss of structurality of the maneuvering organ 10, which can impair the thrusting capacity of this latter. Advantageously, it is possible to define an extrusion coating on one or both the sides of the paper material defining the maneuvering organ 10 with values which can for example vary from 10 to 50 gr/m$^2$ of the coating material (in other words polyethylene). The coating plastic material can be for example selected among the following materials: LDPE, HDPE, PP, PE.

Process for Making the Container

Further, it is an object of the present invention a process for making the container 1 as hereinbefore described. The process comprises at least one step of preparing the compartment 2 which provides to prepare at least one flat sheet and folding the same to define the inner volume 3; as hereinbefore described, the compartment 2 is advantageously made of paper material, therefore, the raw flat sheet can comprise a blank made of paper and/or paperboard.

Further, the process provides to prepare the volume of passage 4, which provides to prepare at least one flat sheet 52 (FIGS. 8 and 9) comprising at least one first, second and third portions 52*a*, 52*b*, 52*c* each exhibiting a substantially rectangular shape. The first and second portions 52*a* and 52*b* are integrally joined to an interconnection longitudinal edge 55 while the second and third portions 52*b*, 52*c* are integrally joined to a respective interconnection longitudinal edge 56; the interconnection edge 55 of the first and second portions 52*a*, 52*b* is opposite to the interconnection longitudinal edge 56 of the second and third portions 52*b*, 52*c* with respect to the second portion itself. Advantageously, the second sheet 52 further comprises a fourth portion 52*d* connected to the third portion 52*c* at a respective interconnection longitudinal edge 60: the third portion 52*c* is interposed between the second and fourth portions 52*b* and 52*d* of the sheet 52. As it is visible in the attached figures, the third portion 52*c* of the second sheet 52 comprises an opening 58 which is configured for defining the opening 7 of the volume of passage 4 of the container 1. The opening 58 is delimited at a free edge 59 defining a substantially "U" shape whose concavity faces away from the third portion 52*c* itself.

Then, the sheet 52 preparing step comprises at least one step of folding the same to define the duct 4. More particularly, the folding step provides the following sub-steps:

folding, at the interconnection longitudinal edge 55, the first and second portions 52*a*, 52*b* so that these latter define, according to a cross section, a substantially "L" shape, folding, at the edge 56, the second and third portions 52*b*, 52*c* so that these latter define, according to a cross section, a substantially "L" shape, the first, second and third portions 52*a*, 52*b*, 52*c* defining, according to a cross section, a substantially "U" shape.

In case the sheet 52 exhibits the fourth portion 52*d*, the process further exhibits at least one sub-step of folding, at the interconnection longitudinal edge 60, the third and fourth portions 52*c*, 52*d* so that these latter define, according to a cross section, a substantially "L" shape whose concavity is opposite to the volume of passage 4.

Figure 8:
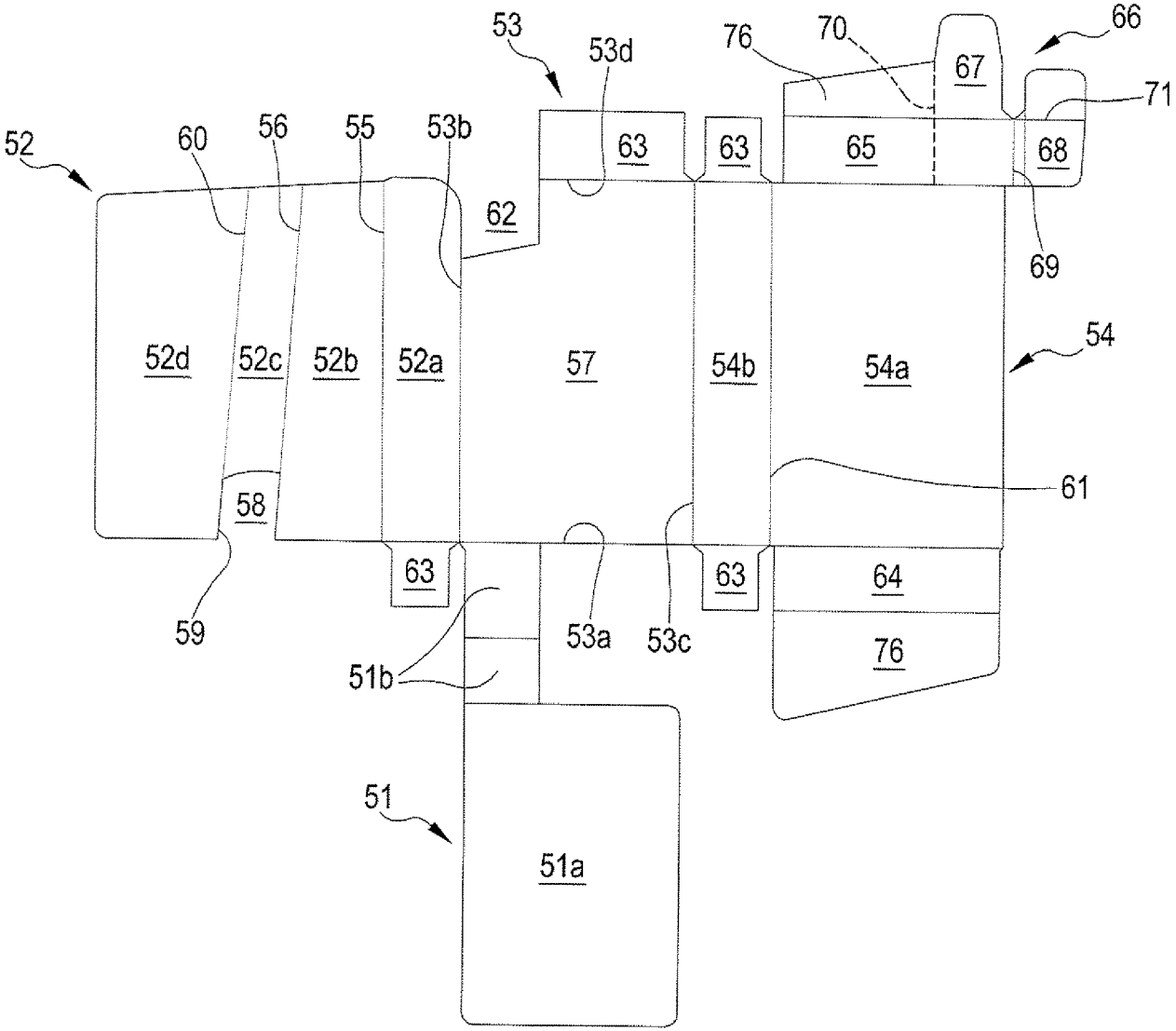
FIG. 8 is an outline of a blank for making a container according to the present invention.
Figure 9:
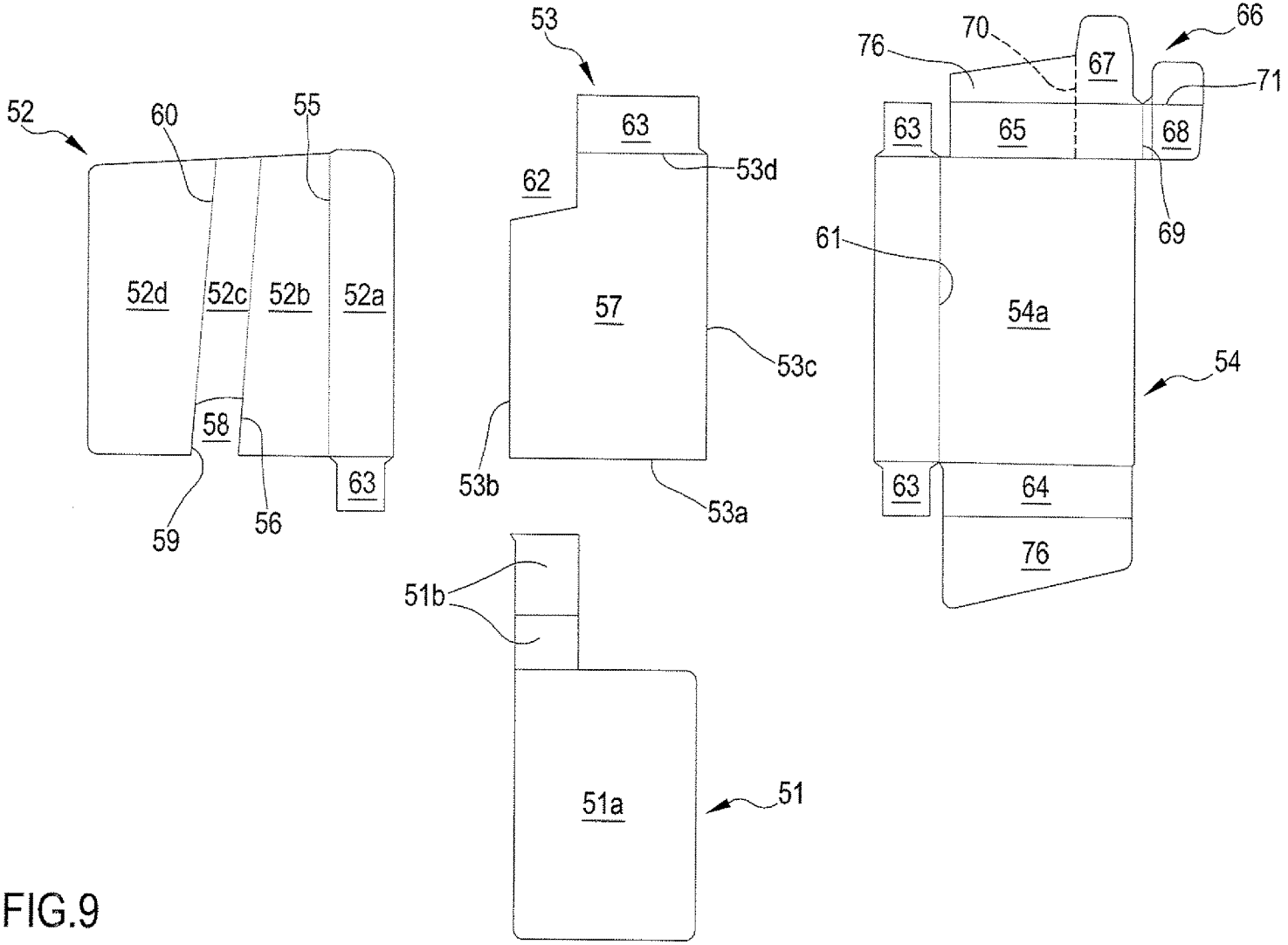
FIG. 9 is a cut-away of the blank in FIG. 8.

As hereinbefore described, the volume of passage 4 and compartment 2 can be made in a single piece; in such condition, such elements are made of a single die-cut flat sheet defining a single blank 50. Particularly, such blank 50 can comprise the sheet 52 connected to two further sheets 53 and 54 (FIGS. 8 and 9). The sheet 53 comprises a main flat body 57 exhibiting a substantially rectangular shape delimited by a lower edge 53*a*, a first and second lateral edges 53*a*, 53*b*, and an upper edge 53*d*. As it is visible in FIGS. 8 and 9, the first lateral edge 53*b* is connected, particularly integrally joined, with the sheet 52, particularly with the first sheet 52 portion 52*a*. At the upper edge 53*d*, particularly at the joining angle between the first edge 53*b* and the upper edge 53*d* of the sheet 53, this latter exhibit a through opening 62 obtained by a step of cutting the sheet 53 itself. The opening 62 is configured for defining the container 1 recess 15. The sheet 54 comprises at least one main body 54*a* and a connecting portion 54*b* both exhibiting a substantially rectangular shape: said portions 54*a*, 54*b* exhibit an interconnection longitudinal edge 61 (FIG. 8). In order to make the compartment 2 and volume of passage 4 in a single piece, the process, following or simultaneously with the step of folding the sheet 52, provides to prepare the first, second and third portions 52*a*, 52*b*, 52*c* folded on the sheet 53 main body 57 in order to define the duct of the volume of passage 4.

Then, the process further provides to fold the main body 54*a* and connecting portions 54*b* of the sheet 54 at the interconnection longitudinal edge 61 to define, according to a cross section, a substantially "L" shape. Then, it is possible to position the sheet 54 on the sheet 52 in order to define both the compartment 2 and duct. It is useful to note that the sheet 52 comprises at least one connecting portion 63 integrally joined to the first portion 52*a* and emerging longitudinally from this latter. The sheet 54 instead comprises a lower abutment portion 64 integrally joined to a main body 54*a* lower edge 54*c* and longitudinally emerging from this latter; the sheet 54 further comprises also two connecting portions 63 integrally joined respectively with an upper and lower edges of the sheet 54 connecting portion 54*b* and longitudinally emerging from these latter. Further, it is observed that the sheet 54 comprises at least one upper abutment portion 65 integrally joined to an upper edge 54*b* of the main body 54 and longitudinally emerging from this latter.

Further the process provides, for defining the compartment 2 and duct, at least the following sub-steps:

folding the lower abutment portion 64 towards the sheet 54 main body 54*a*, following positioning the sheet 54 on the sheet 52, engaging the sheet 54 connecting portion 63 with the abutment portion 64 of the same for holding the abutment portion 64 in the folded configuration, following positioning the sheet 54 on the sheet 52, engaging the sheet 52 connecting portion 63 with the sheet 54 lower abutment portion 64 for granting the engagement of the second and fourth sheets 52, 54, folding the upper abutment portion 65 towards the sheet 54 main body 54*a*, following positioning the sheet 54 on the sheet 52, engaging the sheet 54 connecting portion 63 with the upper abutment portion 65 of the same for holding the abutment portion itself in the folded configuration.

De facto, the sheet 54 abutment portions 64 and 65 are configured for defining the container 1 upper and lower walls, and also the duct bottom wall 4*c* for abutting on the second tab 13. The connecting portions 63 are configured for granting to hold the container 1 in its folded (three-dimensional) configuration.

Further, it is observed that the sheet 54 comprises locking portions 76 emerging from the abutment portions 64 and 65; such portions are configured for being folded after having positioned the sheets 52 and 54 in order to constrain them to the sheet 53 main body 57. Such portions can be folded and glued to the sheet 53 main body 57 in order to hold the container 1 in its three-dimensional configuration, for example.

As hereinbefore described, both the compartment and volume of passage are advantageously made of paper material, therefore, the flat raw sheets 52, 53 and 54 comprise a single blank 57 of paper and/or of paperboard.

As hereinbefore described, further the container 1 can comprise at least one closing element 18. The process provides to prepare at least one flat sheet and folding the same to define the element 18; as hereinbefore described, said element 18 is advantageously made of a paper material, therefore, the raw flat sheet can comprise a paper and/or paperboard blank. Advantageously, the sheet defining the element 18 is integrally joined to the sheet 54 (FIG. 8); particularly, the sheet 54 comprises, at an upper edge 54*d*, a closing portion 66 comprising at least one first and at least one second portions 67, 68 integrally joined by means of an interconnection longitudinal edge 69. The closing portion 66 being adapted to define at least part of the upper abutment portion 65 and is integrally joined to this latter by means of a tear longitudinal edge 70. The process further comprises at least the following sub-steps:

folding, at the sheet 54 upper edge 54*d*, the closing portion 66 towards the lower abutment portion 64, folding, substantially at an intermediate tracing 71, the first and second portions 67, 68 towards the first lower abutment portion 64, the first and second folded portions 67, 68 define, according to a cross section, a substantially "L" shape; the first portion is configured for contacting the sheet 53 main body 57 while the second portion 68 is configured for contacting the sheet 52 first portion 52*a*, folding the second portion 68 towards the first portion 67, stably engaging said first and second folded portions for defining said closing element 18.

Further, the process provides to step of preparing the delivery mechanism 8, during which the shutter 9 and maneuvering organ 10 are formed; as hereinbefore described, the shutter 9 is configured for defining both the section of passage of the container 1 and the spring-back element adapted to automatically restore the shutter itself to the closing condition. The step of preparing the shutter 9 comprises at least the following steps:

preparing a sheet 51, folding said sheet 51 to form the folded portion 11, positioning said folded portion 11 at the door 6.

As hereinbefore described, the folded portion 11 is configured for defining both the door 6 obstruction element and directly the shutter 9 spring-back element. The folded portion 11 forming step comprises at least a step of placing said portion 11 at the door 6 so that said portion 11 can cooperate with the opening 7 for defining the housing seat 14 configured for holding only one product P.

The step of preparing the delivery mechanism 8 comprises at least the step of preparing the maneuvering organ 10 also made of sheet material.

Advantageously, the shutter 9 and the maneuvering organ 10 are both made of the sheet 51, particularly of paper sheet material; as it is visible in FIGS. 8 and 9, the sheet 51 comprises at least one main portion 51*a* and a connecting portion 51*b*. The step of preparing the delivery mechanism 8 provides to fold the connecting portion 51*b* to define said first and second tabs 12, 13 while the main body 51*a* defines the whole maneuvering organ 10. The delivery mechanism 8 of sheet material can be placed inside the compartment 2 and duct before folding and forming these latter; particularly, the mechanism 8 can be abutted on the main body 57 and then the sheets 52, 53 and 54 can be folded for receiving the shutter 9 and organ 10. Advantageously, the flat sheet 51 used for defining the delivery mechanism 8 can be integrally joined to the sheet 53; particularly, in a preferred embodiment, the connecting portion 51*b* is integrally joined, on one side, with the sheet 51 main body 51*a* and, on the other side, with the sheet 53 lower edge 53*a* (FIG. 8).

Figure 10:
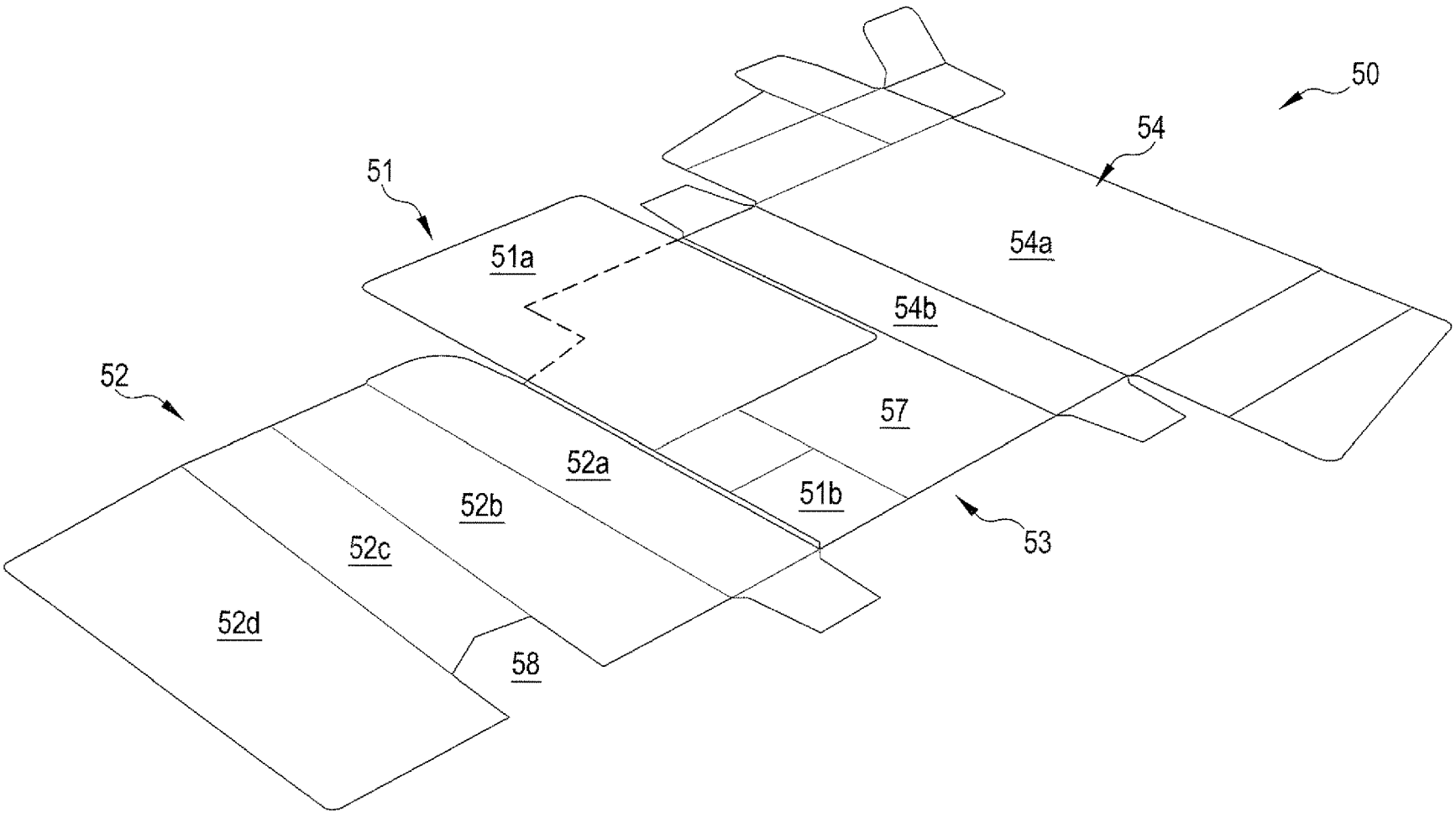
FIGS. 10-12 schematically and in a non limiting way illustrate the possible steps of folding the blank in FIG. 8.
Figure 11:
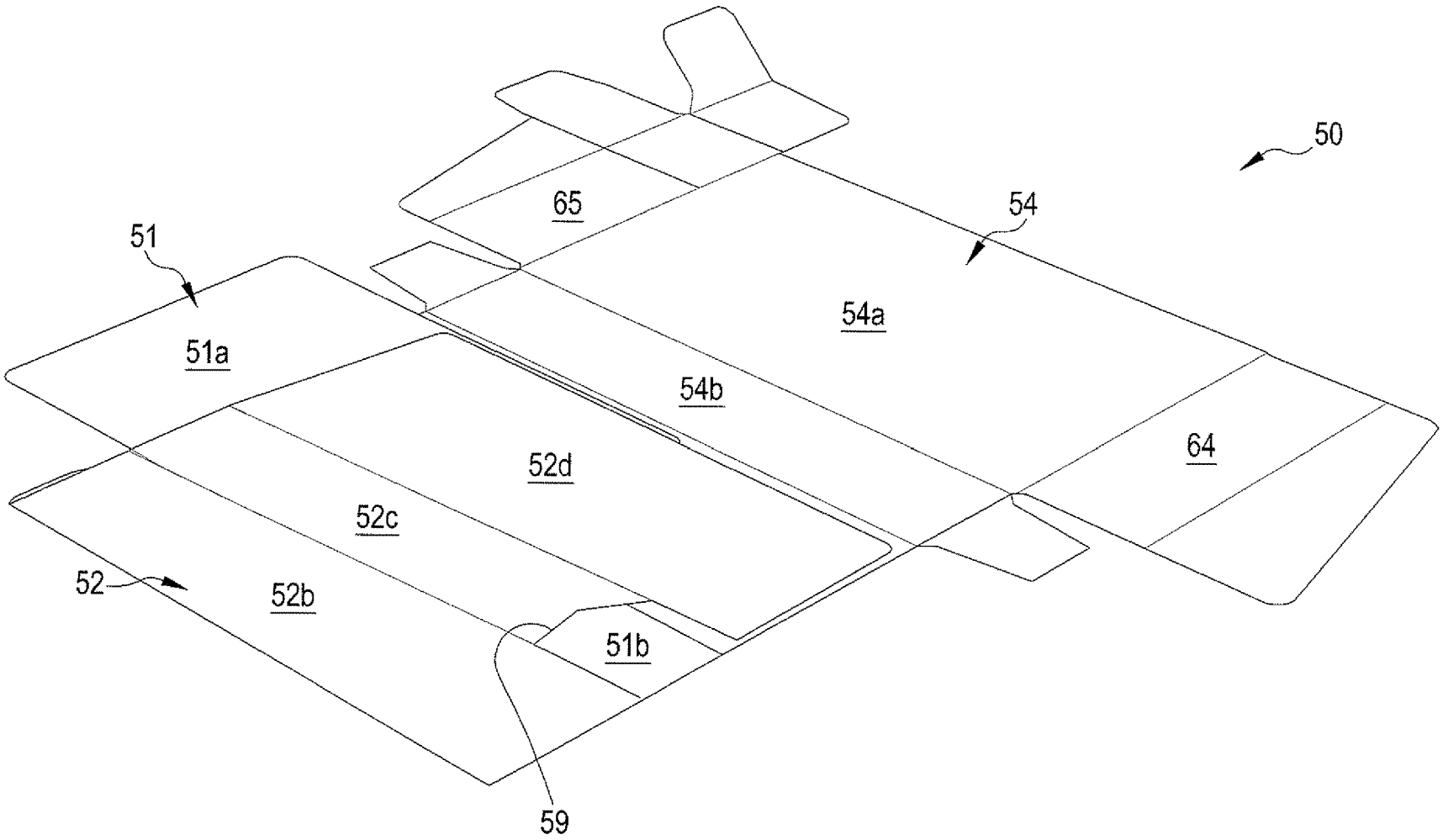
Figure 12:
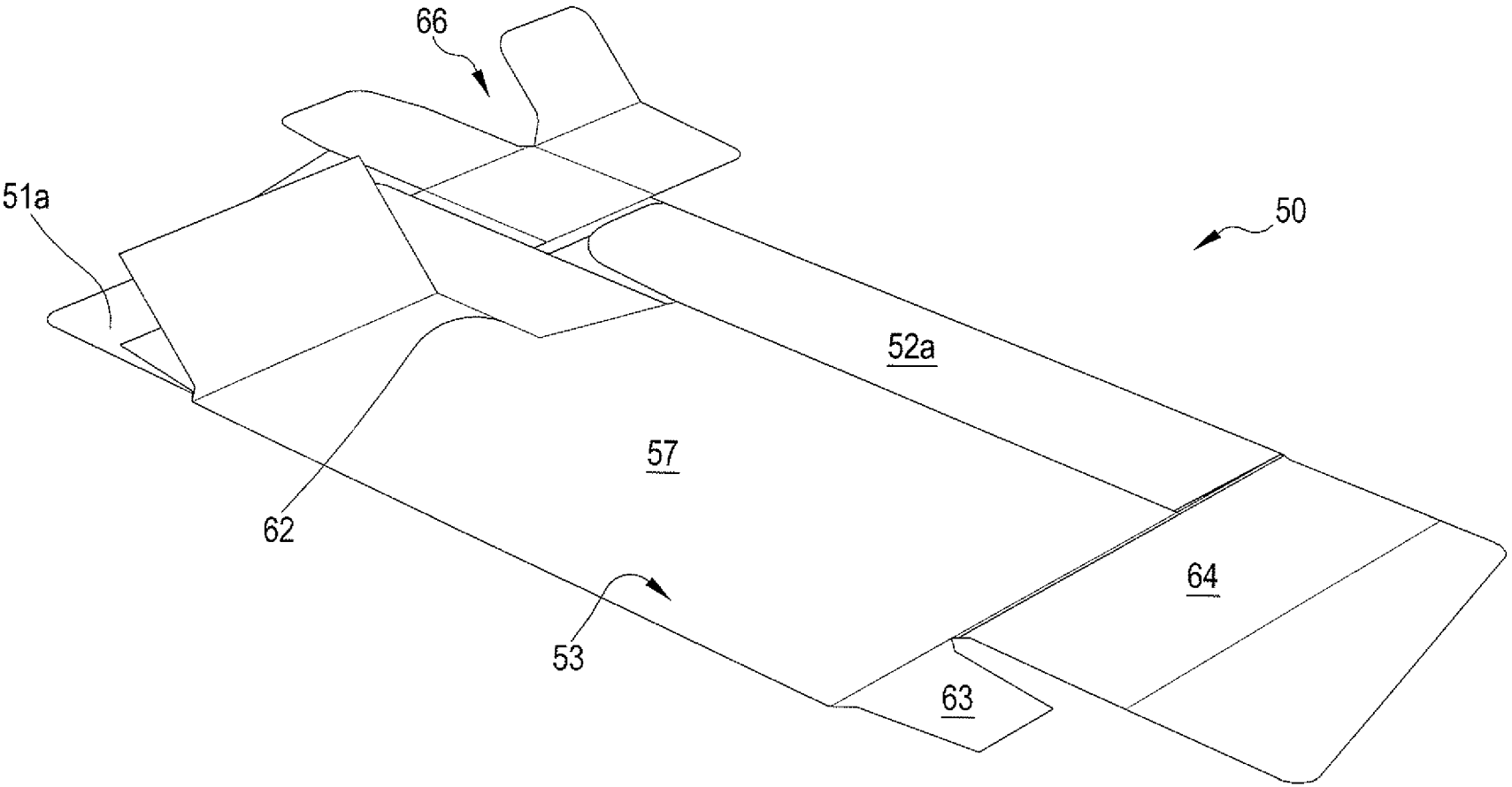

In a preferred embodiment of the invention, the container 1 is obtained from a single blank 50 comprising the sheets 51, 52, 53 and 54 defined also as first, second, third and fourth sheets. In such condition, the process provides to cut a single flat sheet to define a single blank 50 as illustrated in FIG. 8. The first step of the process provides to fold the first sheet 51 connecting portion 51*b* and place the main body 51*a* of the same on the third sheet 53 main body 57. The connecting portion is folded to define the portion 11 which exhibits, according to a cross section, a "V" shape whose concavity faces the third sheet 53 main body 47. Then, the second sheet 52 is folded and is placed on the third sheet 53 so that the second sheet 52 duct houses the shutter 9 folded portion 11; de facto the folded portion 11 is interposed between the second portion 52*b* of the second sheet 52 and the third sheet 53 main body 57, while the fourth portion 52*d* of the second sheet 52 abuts at least on part of the maneuvering organ 10. Following positioning the first and second sheets 51, 52 on the third sheet 53, the process provides to place and then fix the fourth sheet 54 on the second sheet 52: the second, third and fourth sheets 52, 53, 54 define the compartment 2, the volume of passage and also the container 1 lateral walls. In FIG. 9 it is possible to observe with a detailed and exploded view the structure of the first, second, third and fourth sheets 51, 52, 53, 54. Instead, Figures from 10 to 13 schematically show the blank 50 folding steps adapted to define a semi-finished product folded in a compact form and ready for being arranged in the three-dimensional configuration illustrated in FIGS. 1 and 2, for example. FIG. 10 illustrates a first step of folding the whole first sheet 51 on the third sheet 53. FIG. 10 schematically shows a second step of folding at least part of the second sheet 52 on the first sheet 51. Particularly, the second, third and fourth portions 52*b*, 52*c* and 52*d* of the second sheet are all folded on the first sheet 51 around the interconnection longitudinal edge 55 of the second sheet 52. Then, the third sheet 53 with the first and second sheets 51, 53 are folded on the fourth sheet 54 around the second lateral edge 53*c* of the third sheet 53. The folded blank 50 is easily configurable in its three-dimensional shape in which it is possible to proceed with locking the same by fixing the different connection and locking portions 63 and 76 of the second and fourth sheets 52, 54.

The invention claimed is:

1. A container for delivering a predetermined number of products at a time, the container comprising:

a compartment defining an inner volume and configured to house a plurality of products, a passageway having an outlet configured to enable delivery of the plurality of products outside of the container, a door defining an opening configured to put the compartment in communication with the passageway, and a delivery mechanism arranged at the door and configured to manage passage of the plurality of products through the door, the delivery mechanism being configured to be placed in a closing condition in which the delivery mechanism prevents passage of the plurality of products through the door, and the delivery mechanism being further configured to be placed in a passage condition in which the delivery mechanism allows passage of one or more products of the plurality of products through the door, thus allowing the one or more products to exit the compartment, the delivery mechanism comprising:

a shutter located at the door and defining, in cooperation with the opening, a pathway, wherein the shutter, in the closing condition, defines a first portion of the pathway configured to prevent passage of the plurality of products, and wherein the shutter, in the passage condition, defines a second portion of the pathway configured to enable passage of the plurality of products, and a maneuvering element acting on the shutter to effect the closing and passage conditions of the delivery mechanism, wherein the shutter is made at least partially of sheet material and has a folded portion configured to directly define a shutting and opening body of the door, wherein the folded portion comprises a first tab and a second tab connected at an end of the folded portion, the first and second tabs normally being arranged in the closing condition of the delivery mechanism in which the first and second tabs are spaced apart from each other and define an angle therebetween, wherein the folded portion is configured to deform and to allow the first and second tabs to fold toward each other to define the passage condition of the delivery mechanism, and wherein the folded portion comprises an elastic body configured to maintain the shutter in the closing condition, the elastic body being configured to automatically adjust the shutter from the passage condition to the closing condition.

2. The container according to claim 1, wherein the first and second tabs lie in respective planes parallel to a crossing direction along which the one or more products cross the door, wherein the first and second tabs, in the closing condition, exhibit a substantially "V" shape that is transverse to the crossing direction and configured for obstructing the opening to prevent passage of the one or more products.

3. The container according to claim 1, wherein the delivery mechanism is made at least partially of paper sheet material.

4. The container according to claim 1, wherein the folded portion directly defines both the shutting and opening body of the door and the elastic body for a springback of the shutter.

5. The container according to claim 1, wherein the maneuvering element is located inside of the passageway and extends from a first end located at the outlet to a second end connected to the shutter and arranged at the opening, the maneuvering element being configured to:

receive, at the first end, a thrust directed towards the shutter, following the thrust, slide internally within the passageway to exert the thrust on the shutter, and following the sliding action, wherein the passageway comprises a duct extending along a prevalent development direction, wherein the outlet is located at a first longitudinal end of the duct, wherein the opening is substantially located in a first lateral wall of the duct at a second longitudinal end of the duct substantially opposite to the first longitudinal end, and wherein the prevalent development direction extends transverse to a crossing direction of the one or more products, wherein the duct and the compartment share a same lateral partition wall, and wherein the compartment and the passageway are made of folded paper sheet material.

6. The container according to claim 1, wherein the first and the second tabs, in the closing condition of the shutter, define an angle therebetween, the angle being in a range of 10° to 90°, and wherein the first and the second tabs, in the passage condition of the shutter, are substantially parallel to each other.

7. The container according to claim 1, wherein the container comprises a closing element engaged with the passageway and/or the compartment, the closing element being located at the outlet outside of the passageway and outside of the compartment, wherein the closing element is configured for being placed, in a condition of passage wherein the closing element enables delivery of the plurality of products from the outlet, and wherein the closing element is further configured for being placed in a locking condition wherein the closing element closes the outlet and prevents the delivery of products from the outlet.

8. The container according to claim 1, wherein the folded portion defines, in the closing condition of the delivery mechanism and in cooperation with the opening, a housing seat configured to retain one and only one product of the plurality of products, the housing seat being configured to substantially define a dosing chamber which, in the passage condition of the delivery mechanism, enables delivery of the one and only one product retained in the housing seat.

9. The container according to claim 8, wherein the first tab, in the closing condition of the delivery mechanism, cooperating with the opening to define the housing seat, and during transit from the passage condition to the closing condition, is configured to approach or to move away from the second tab for defining the passage condition and enabling the delivery of the one and only one product retained in the housing seat.

10. A container for delivering a predetermined number of products at a time, the container comprising:

a compartment defining an inner volume and configured to house a plurality of products, a passageway having an outlet configured to enable delivery of the plurality of products outside of the container, a door defining an opening configured to put the compartment in communication with the passageway, and a delivery mechanism arranged at the door and configured to manage passage of the plurality of products through the door, the delivery mechanism being configured to be placed in a closing condition in which the delivery mechanism prevents the passage of the plurality of products through the door, the delivery mechanism being further configured to be placed in a passage condition in which the delivery mechanism allows the passage of one or more products of the plurality of products through the door, thus allowing the one or more products to exit the compartment, the delivery mechanism comprising:

a shutter located at the door and configured to define, in cooperation with the opening, a pathway, the shutter, in the closing condition, defining a first portion of the pathway configured to prevent the passage of the one or more products, the shutter, in the passage condition, defining a second portion of the pathway configured to enable the passage of the one or more products, wherein the shutter is made at least partially of sheet material and has a folded portion, the folded portion being configured to directly define a shutting and opening body of the door, the folded portion exhibiting at least a first and a second tab connected at one end, said first and second tab being normally arranged in a condition in which they are angularly spaced from each other for defining said closing condition of the delivery mechanism, said folded portion being configured to deform and allow said tabs to angularly approach to each other so as to define said passage condition of the delivery mechanism, and at least one maneuvering element acting on the shutter so as to effect the closing and passage conditions of the delivery mechanism, wherein the maneuvering element is located inside of the passageway and extends from a first end located at the outlet to a second end directly connected to the first tab of the shutter and arranged at the opening, the maneuvering element being configured to:

receive, at the first end, a thrust directed towards the shutter, following the thrust, slide internally within the passageway to exert the thrust on the shutter, and following the sliding action, elastically deform the shutter to move the delivery mechanism from the closing condition to the passage condition.

11. The container according to claim 10, wherein the folded portion comprises a first tab and a second tab connected at an end, the first and second tabs being normally arranged in a closing condition of the delivery mechanism in which they are angularly spaced from each other, the folded portion being configured to deform and allow the first and second tabs to angularly approach each other so as to define the passage condition of the delivery mechanism, wherein the first and second tabs lie in respective planes parallel to a crossing direction along which the plurality of products cross the door.

12. The container according to claim 11, wherein the first and second tabs, in the closing condition, exhibit a substantially "V" shape that is transverse to the crossing direction and configured for obstructing the opening to prevent passage of the one or more products.

13. The container according to claim 10, wherein the container comprises a closing element engaged with the passageway and/or the compartment, the closing element being located at the outlet outside of the passageway and outside of the compartment, wherein the closing element is configured for being placed, in a condition of passage wherein the closing element enables delivery of the plurality of products from the outlet, and wherein the closing element is further configured for being placed in a locking condition wherein the closing element closes the outlet and prevents the delivery of the plurality of products from the outlet.

* * * * *